US008438817B2

(12) United States Patent
Sankaran et al.

(10) Patent No.: US 8,438,817 B2
(45) Date of Patent: May 14, 2013

(54) METHOD FOR PACKAGING OF MASS-FABRICATED CUSTOM ITEMS

(75) Inventors: Stanley E. Sankaran, Granite Bay, CA (US); Eric Kuo, Foster City, CA (US); Kevin M. Conlon, Berthoud, CO (US); Josh Van Riper, Berthoud, CO (US)

(73) Assignee: Align Technology, Inc., San Jose, CA (US)

( * ) Notice: Subject to any disclaimer, the term of this patent is extended or adjusted under 35 U.S.C. 154(b) by 22 days.

(21) Appl. No.: 12/787,288

(22) Filed: May 25, 2010

(65) Prior Publication Data

US 2010/0234982 A1 Sep. 16, 2010

Related U.S. Application Data

(62) Division of application No. 11/670,897, filed on Feb. 2, 2007, now Pat. No. 7,748, 199.

(60) Provisional application No. 60/867,571, filed on Nov. 28, 2006.

(51) Int. Cl.
*B65B 57/00* (2006.01)
*B65B 61/02* (2006.01)

(52) U.S. Cl.
USPC ..... 53/411; 53/445; 53/459; 53/474; 700/216; 700/225; 700/235

(58) Field of Classification Search ..... 53/411, 53/445, 459, 474, 131.2–131.5, 168, 155, 53/170, 263, 238, 237; 700/216, 225, 235
See application file for complete search history.

(56) References Cited

U.S. PATENT DOCUMENTS 3,409,195 A 11/1968 Gustav
4,241,562 A 12/1980 Meyer (Continued)

FOREIGN PATENT DOCUMENTS

DE 10332538 2/2005
EP 1388336 2/2004

(Continued)

OTHER PUBLICATIONS

International Search Report from European Patent Office for International Application No. PCT/US2007/085571 dated Sep. 9, 2008.

(Continued)

*Primary Examiner* — Stephen F Gerrity
(74) *Attorney, Agent, or Firm* — Klein, O'Neill & Singh, LLP

(57) ABSTRACT

A system for packaging mass-customized items includes a computer system including a database containing item identification information unique to each item; (2) outer container identification apparatus that applies the item identification information received from the database to each outer container in a plurality of outer containers; (3) inner pack identification apparatus that applies the item identification information received from the database to each inner pack in a plurality of inner packs; and (4) inner pack filling apparatus that fills each inner pack with a specific item matched to that inner pack by the item identification information received from the database. Each item is associated with its unique item identification information and is inserted into an inner pack with matching item identification information, and each outer container is presented for loading with one or more inner packs matched to that outer container by the item identification information received from the database.

20 Claims, 16 Drawing Sheets

U.S. PATENT DOCUMENTS

| | | | | | |
|---|---|---|---|---|---|
| 4,509,123 | A | * | 4/1985 | Vereen | 700/225 |
| 4,972,657 | A | * | 11/1990 | McKee | 53/411 |
| 5,097,652 | A | | 3/1992 | Inamura et al. | |
| 5,385,438 | A | * | 1/1995 | Fadaie | 414/810 |
| 5,390,796 | A | * | 2/1995 | Kerfoot, Jr. | 206/534 |
| 5,533,606 | A | | 7/1996 | Yuyama | |
| 5,604,692 | A | | 2/1997 | Yuyama | |
| 5,709,063 | A | | 1/1998 | Yuyama et al. | |
| 5,713,485 | A | | 2/1998 | Liff et al. | |
| 5,713,487 | A | | 2/1998 | Coughlin | |
| 5,720,154 | A | | 2/1998 | Lasher et al. | |
| 5,771,657 | A | | 6/1998 | Lasher et al. | |
| 5,839,257 | A | * | 11/1998 | Soderstrom et al. | 53/411 |
| 5,839,836 | A | | 11/1998 | Yuyama et al. | |
| 5,852,911 | A | * | 12/1998 | Yuyama et al. | 53/168 |
| 5,855,105 | A | * | 1/1999 | Ferris | 53/475 |
| 5,875,610 | A | | 3/1999 | Yuyama et al. | |
| 6,370,841 | B1 | * | 4/2002 | Chudy et al. | 53/411 |
| 6,470,648 | B1 | | 10/2002 | Baker | |
| 6,597,969 | B2 | | 7/2003 | Greenwald et al. | |
| 6,701,218 | B2 | | 3/2004 | Koike et al. | |
| 6,892,512 | B2 | | 5/2005 | Rice et al. | |
| 6,957,522 | B2 | | 10/2005 | Baldwin et al. | |
| 7,010,899 | B2 | | 3/2006 | McErlean et al. | |
| 7,061,831 | B2 | * | 6/2006 | De La Huerga | 368/10 |
| 7,454,880 | B1 | * | 11/2008 | Austin et al. | 53/411 |
| 2004/0065053 | A1 | | 4/2004 | Rice et al. | |
| 2004/0172915 | A1 | | 9/2004 | Baldwin et al. | |
| 2005/0003319 | A1 | * | 1/2005 | Kuo | 433/6 |
| 2005/0161875 | A1 | * | 7/2005 | Yuyama et al. | 271/2 |
| 2005/0166549 | A1 | | 8/2005 | Bongers et al. | |
| 2006/0074521 | A1 | * | 4/2006 | Rice et al. | 700/216 |
| 2006/0090422 | A1 | * | 5/2006 | McErlean et al. | 53/411 |
| 2006/0161294 | A1 | | 7/2006 | DiMaggio | |
| 2006/0225381 | A1 | | 10/2006 | Baldwin | |
| 2007/0067250 | A1 | | 3/2007 | Mahar | |
| 2007/0182087 | A1 | | 8/2007 | Yasuoka et al. | |

FOREIGN PATENT DOCUMENTS

| | | |
|---|---|---|
| EP | 1502853 | 2/2005 |
| WO | WO 2005/087175 | 9/2005 |

OTHER PUBLICATIONS

Written Opinion from European Patent Office for International Application No. PCT/US2007/085571 dated Sep. 9, 2008.

Office Action from USPTO dated Dec. 16, 2009 for U.S. Appl. No. 11/670,897.

Notice of Allowance from USPTO dated May 10, 2010 for U.S. Appl. No. 11/670,897.

* cited by examiner

FIG. 6
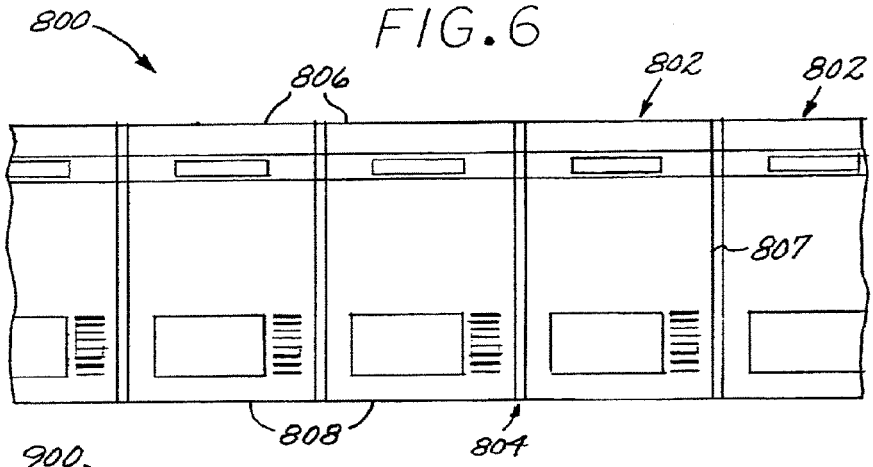
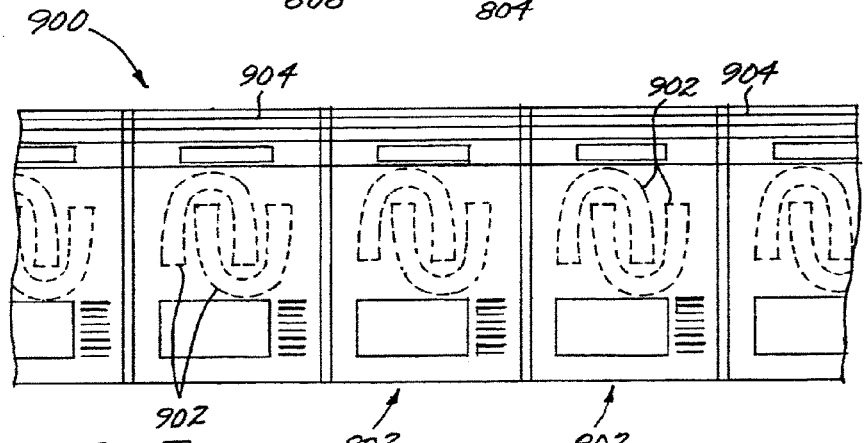
FIG. 7
FIG. 8
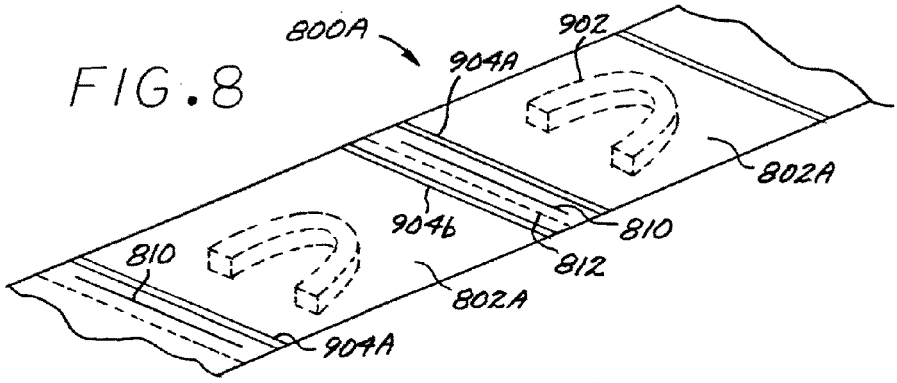

FIG. 9
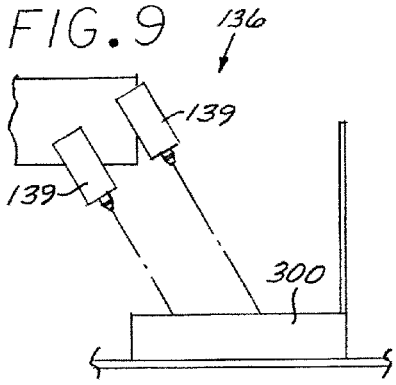
FIG. 10
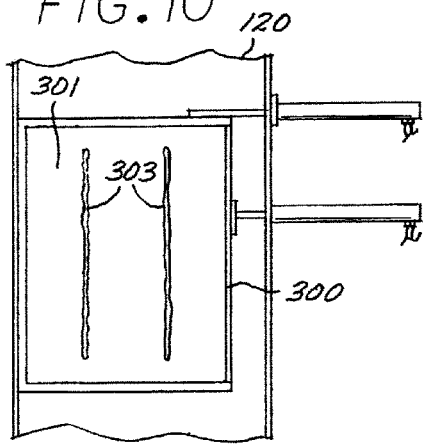
FIG. 11
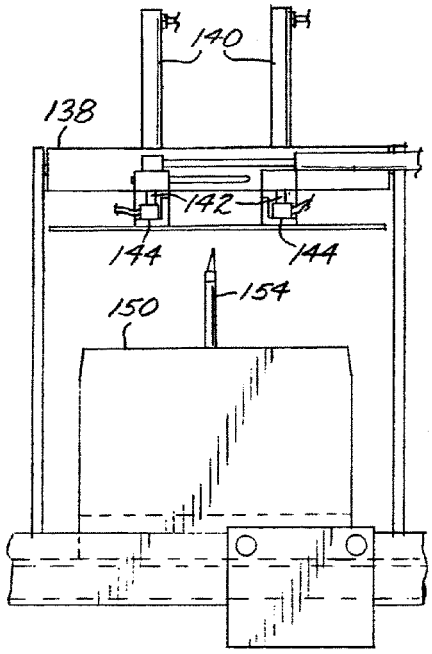
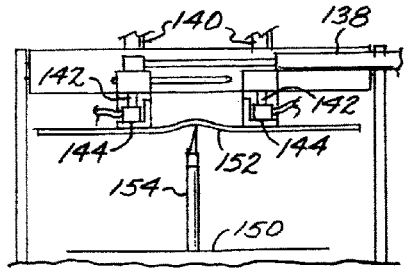
FIG. 12
FIG. 13
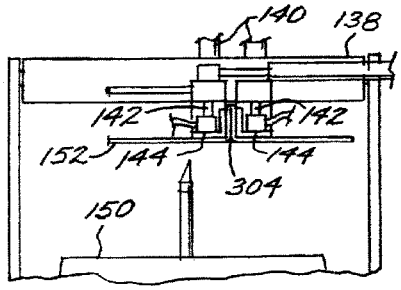

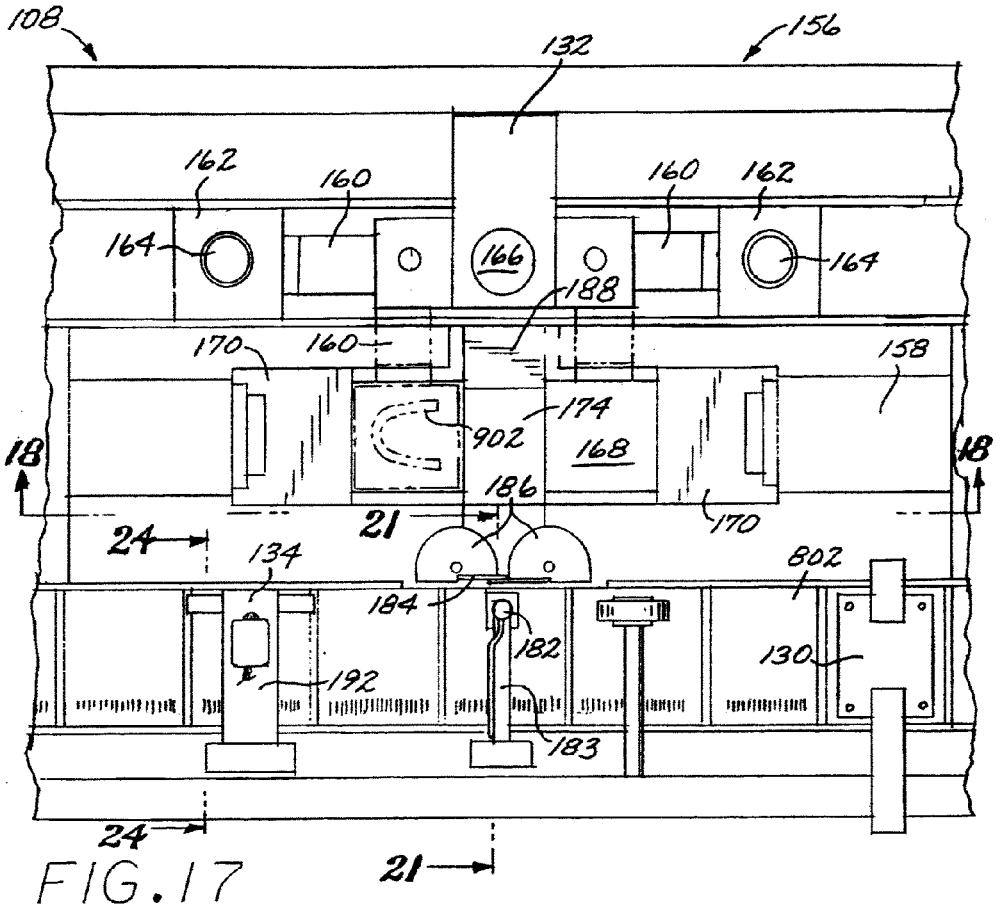
FIG. 17
FIG. 18
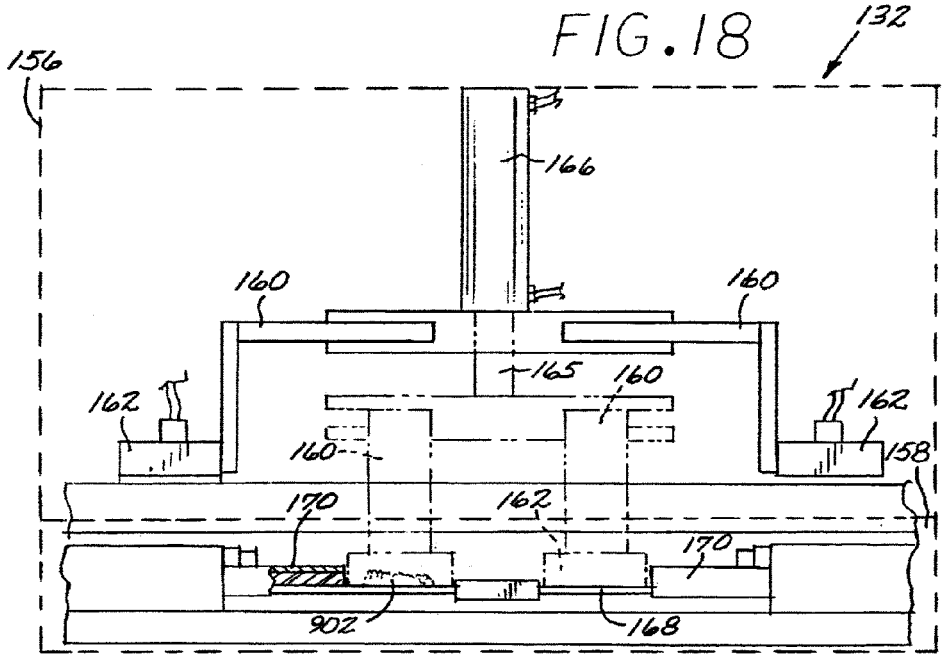

FIG. 19
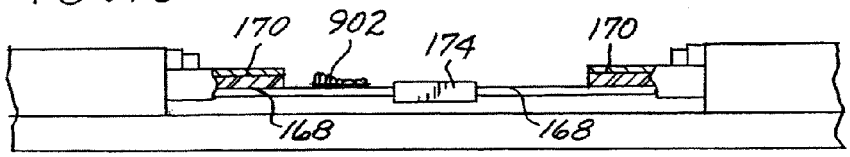
FIG. 20
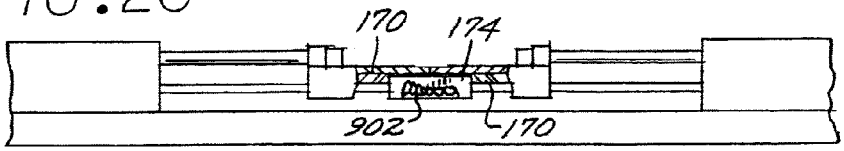
FIG. 21
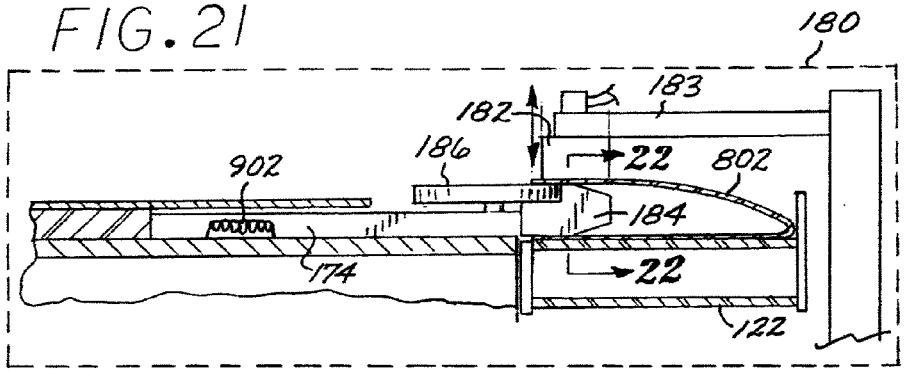
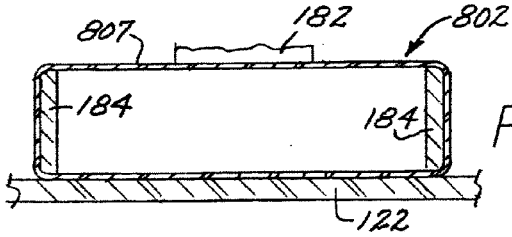
FIG. 22
FIG. 23
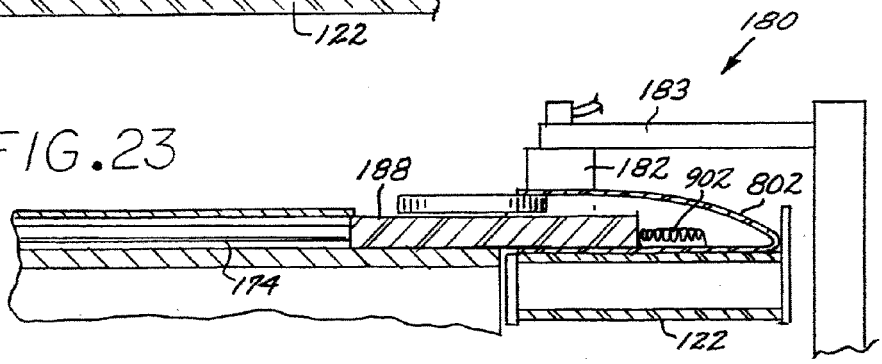

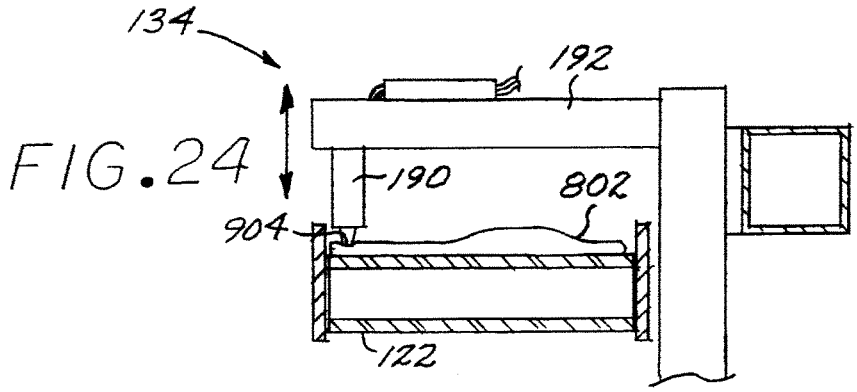
FIG. 24
FIG. 25
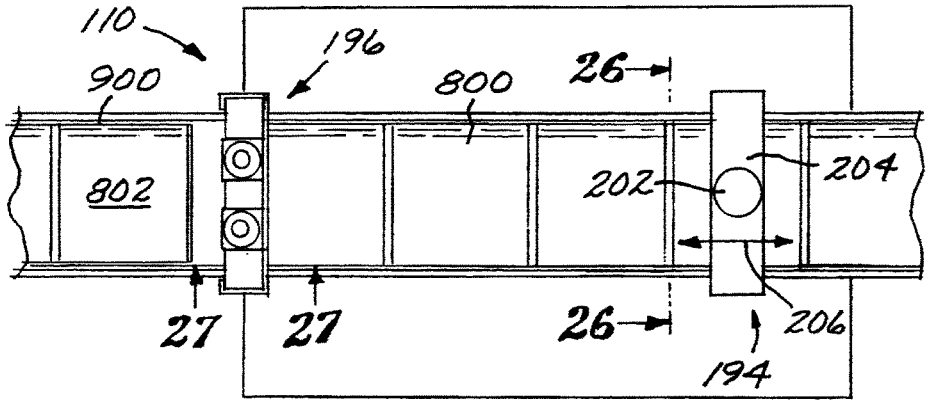
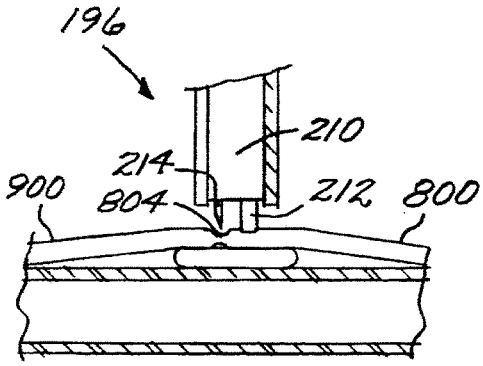
FIG. 27
FIG. 26
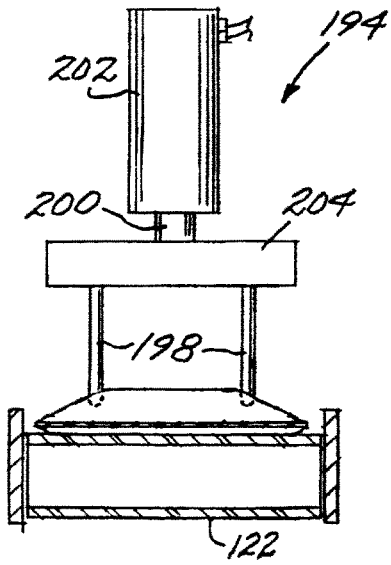

METHOD FOR PACKAGING OF MASS-FABRICATED CUSTOM ITEMS

CROSS-REFERENCE TO RELATED APPLICATIONS

This application is a divisional of application Ser. No. 11/670,897, filed Feb. 2, 2007, now U.S. Pat. No. 7,748,199, which claims the benefit and priority, under 35 U.S.C. §119 (e), of U.S. Provisional Patent Application No. 60/867,571 filed on Nov. 28, 2006, the disclosures of which are incorporated herein in their entirety.

FEDERALLY SPONSORED RESEARCH OR DEVELOPMENT

Not Applicable

BACKGROUND OF THE INVENTION

1. Field of the Invention

This invention relates to the field of mass fabrication of customized items, and more particularly to a method for packaging such items in a predetermined sequence.

2. Description of the Related Art

Virtually all consumer products are sold in packages, such as cardboard cartons, boxes, bags, and other types of containers. A box or carton, for example, is typically formed from a sheet of corrugated cardboard or carton board through a series of manufacturing operations, such as folding and gluing, used to transform the sheet of work material into a carton or box having a desired structural design. Further operations may add additional features to the package, such as the application of labels and stickers. Eventually, the box is filled with a desired content, and then sealed and (optionally) labeled. Frequently, the items packed in the box are first placed in inner packages, such as plastic bags, small boxes, plastic cases, shrink-wrap packs, and the like; thereby further adding to the packaging costs. Containing the cost of the packaging operation, while maintaining quality, is an important aspect of the overall manufacturing cost structure.

The packaging of mass-fabricated custom items, or "mass-customized" items, presents further challenges. Each mass-customized item is unique, while belonging to a group or class based on common features. Examples of mass-customized items could include such things as form-fitting hearing aids, clothing, athletic devices (e.g., pads, protectors and the like), and prosthetic devices. One particular example of a mass-customized item is the type of orthodontic appliance known as a dental repositioning aligner, which may be a clear, elastic dental repositioning appliance created by thermoforming a thin sheet of polymeric material over a mold of a desired dentition arrangement, as described more fully in U.S. Pat. No. 5,975,893, the disclosure of which is incorporated herein by reference. These aligners are formed in a set for each individual patient, with each set including a series of aligners (anywhere from two to over one hundred unique aligners each distinct in configuration) generated for a specific sequence of dentition repositioning steps, usually for each of the upper and lower dental arches. Thus, each individual patient will normally require a series of aligners, in pairs for the upper and lower arches, wherein each upper/lower aligner pair must be worn in a predetermined sequence of stages (each stage comprising, typically, an upper/lower aligner pair). The aligners must be properly identified and packaged, with each package including the aligners for a single patient, preferably (but not necessarily) packed in a predetermined sequence (typically, in reverse order of the stages from bottom to top). The package or box for each patient must then be provided with the appropriate identification label.

In the past, many of the packaging procedures for mass-customized items such as dental aligners have involved laborious manual operations. Accordingly, there is a need for an efficient system and method to improve productivity by automating as many of these steps as possible, while assuring that accurate packaging in the proper sequence for the items in each package is accomplished.

SUMMARY OF THE INVENTION

A system and associated method is provided for packaging mass-customized items. The system includes a database including item identification information unique to a mass-customized item of a series of sequenced mass-customized items; outer container identification apparatus for applying the item identification information received from the database to each outer container of a plurality of outer containers; and a filling apparatus for filling each outer container with at least two mass-customized items matched to the outer container by the item identification information. Each outer container is presented for loading with the at least two mass-customized items.

This brief summary has been provided so that the nature of the invention may be understood quickly. A more complete understanding of the invention can be obtained, by reference to the following detailed description of the preferred embodiments thereof, in connection with the attached drawings.

BRIEF DESCRIPTION OF THE DRAWINGS

FIG. 6 shows an exemplary continuous, edge-wise connected bag string after label printing, but prior to the bags being filled;

FIG. 7 shows an exemplary multi-bag strip after the bags have been filled and sealed, and after the bag strips have been cut FIG. 8 shows an alternative multi-bag strip configuration, in which the bags are connected end-to-end, after the bags have been filled and sealed;

FIG. 9 is a simplified elevational view of the adhesive application mechanism used in the divider insertion station of the present invention;

FIG. 10 is a plan view of a box after the application of adhesive to the bottom surface thereof by the adhesive application mechanism of FIG. 9;

FIGS. 11-13 are front elevational views of divider forming and insertion mechanism employed in the divider insertion station, showing the steps of forming a box divider;

FIG. 17 is a top plan view of the bagging station of FIG. 16;

FIG. 18 is a cross-sectional view taken on line 18-18 of FIG. 17;

FIG. 19 is a cross-sectional view similar to that of FIG. 18, but without showing the pickup and delivery system employed at the bagging station;

FIG. 20 is a cross-sectional similar that of FIG. 19, showing an aligner having been moved over into a insert channel;

FIG. 21 is a cross-sectional view taken on line 21-21 of FIG. 17, showing how the bags are opened;

FIG. 22 is a cross-sectional view taken on line 22-22 of FIG. 21;

FIG. 23 is a cross-sectional view, similar to that of FIG. 21, showing the aligner being inserted into the bag;

FIG. 24 is a cross-sectional view taken on line 24-24 of FIG. 17, showing an open end of the bag being sealed;

FIG. 25 is a top plan view of a bag strip cutting apparatus employed in an embodiment of the present invention;

FIG. 26 is an elevation view of the bag feeding mechanism of the cutting apparatus, taken along line 26-26 of FIG. 25;

FIG. 27 is an elevation view of the bag strip cutting mechanism of the cutting apparatus, taken along line 27-27 of FIG. 25;

DETAILED DESCRIPTION OF THE INVENTION

The present invention provides a system and a method for packaging mass-produced customized items. In the following detailed description of the invention, the invention is described primarily in context of a method for packaging dental appliances, such as dental aligners. However, it should be understood that the system and processes of the present invention may be employed in the packaging of various other types of items, work pieces, or parts, such as prosthetic body parts, implantable hearing aids, eyeglass lenses, clothes and wearable athletic equipment (such as, pads, protectors, gloves, etc.). If the items are dental aligners, they may be of the type described, for example, in the above-referenced U.S. Pat. No. 5,975,893.

Figure 1:
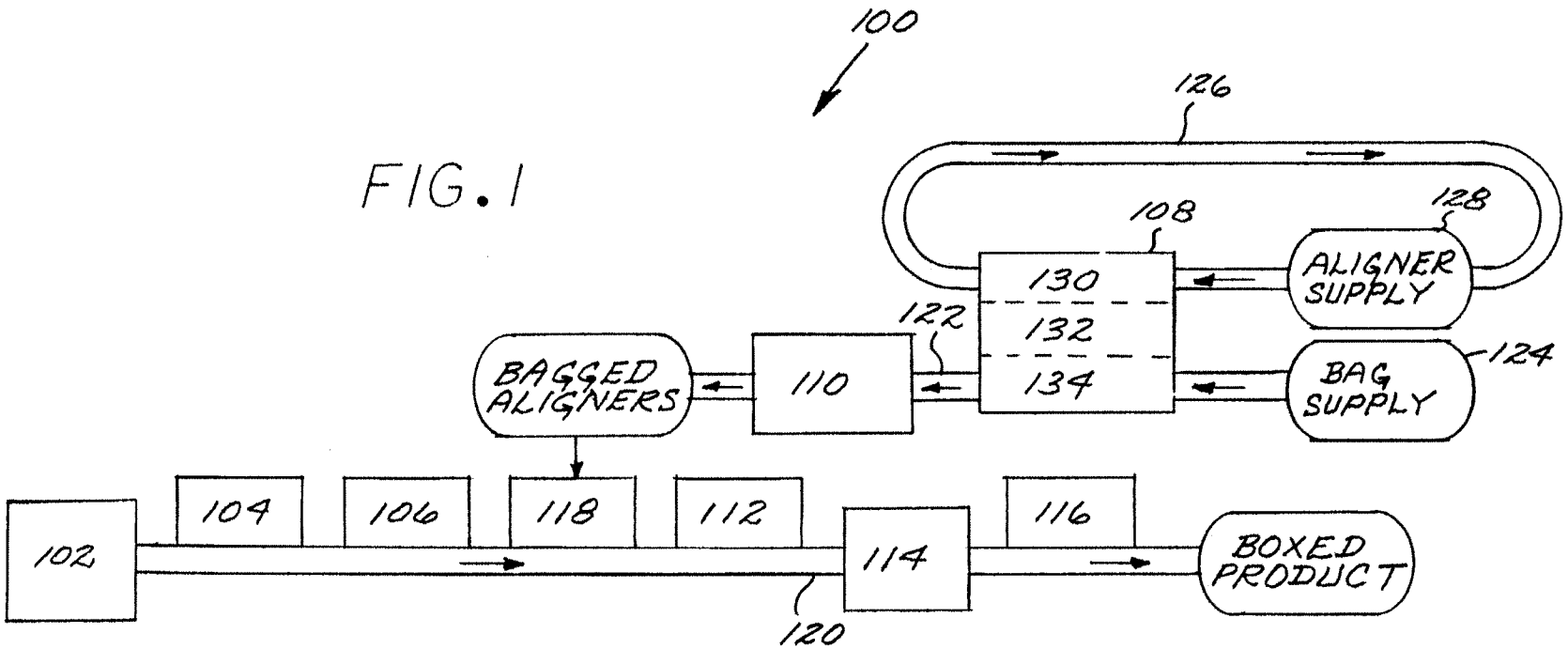
FIG. 1 is a diagrammatic illustration of a packaging system in accordance with an embodiment of the present invention.

FIG. 1 is a diagrammatic illustration of a semi-automated packaging system 100 for packaging mass-customized items (e.g., dental aligners) in accordance with an embodiment of the present invention. The packaging system 100 includes the following functional stations or cells: a box former 102, a divider installation station 104, a box label applicator 106, a bagging apparatus 108 (to be described more fully below), a bag strip cutting station 110, a literature printing/insertion apparatus 112, a box closer 114, and a tamper seal applicator 116. In addition, there is a box loading station 118, where strips of filled, sealed, and labeled bags are manually loaded into boxes, as described below.

Figure 2A:
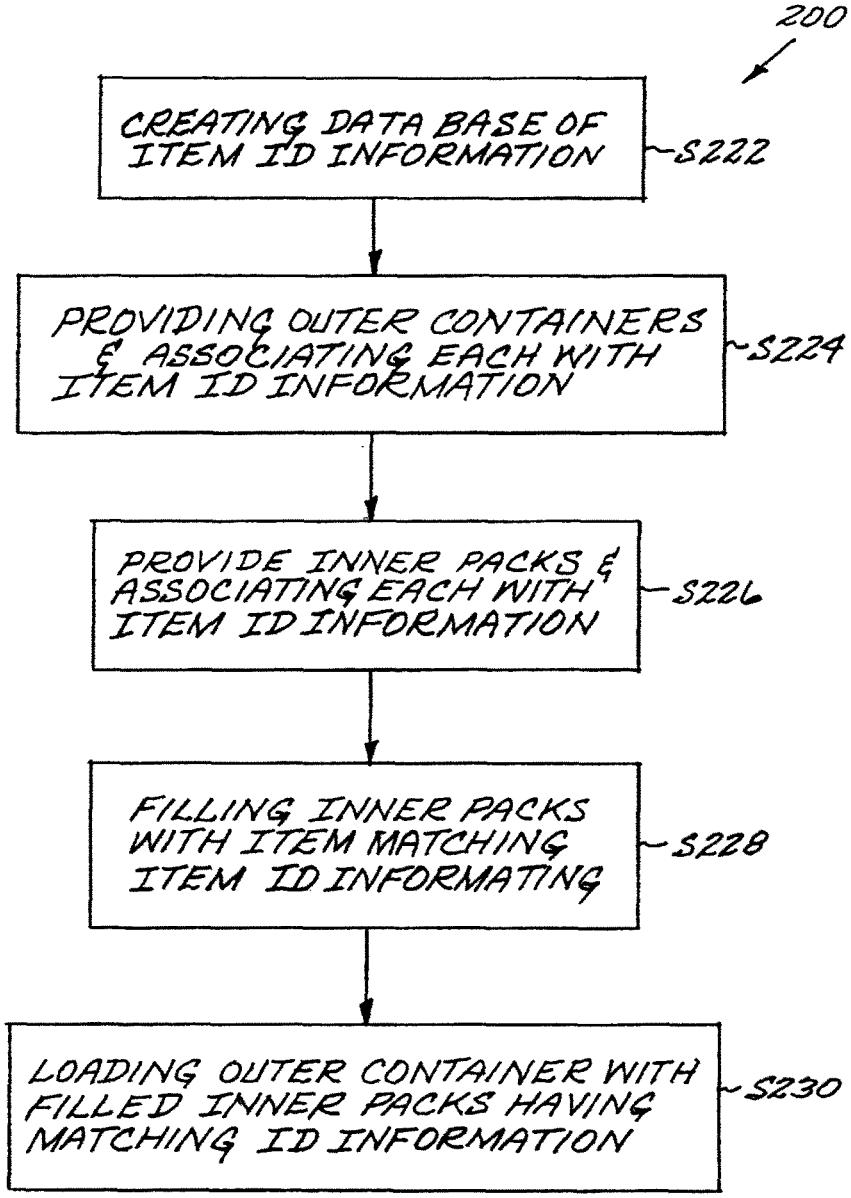
FIGS. 2A, 2B and 2C are flowcharts describing a packaging method in accordance with an embodiment of the present invention.
Figure 2B:
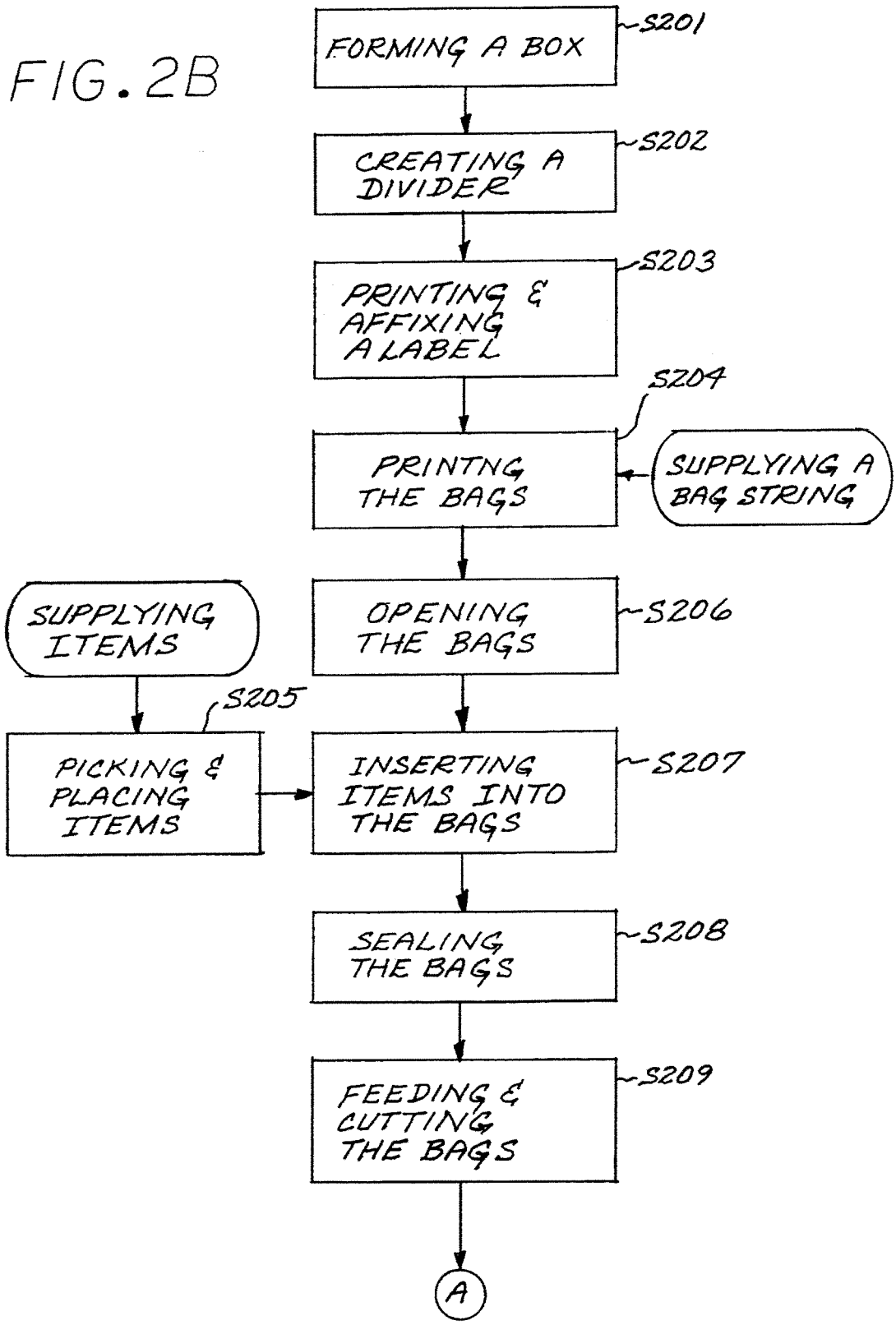
Figure 2C:
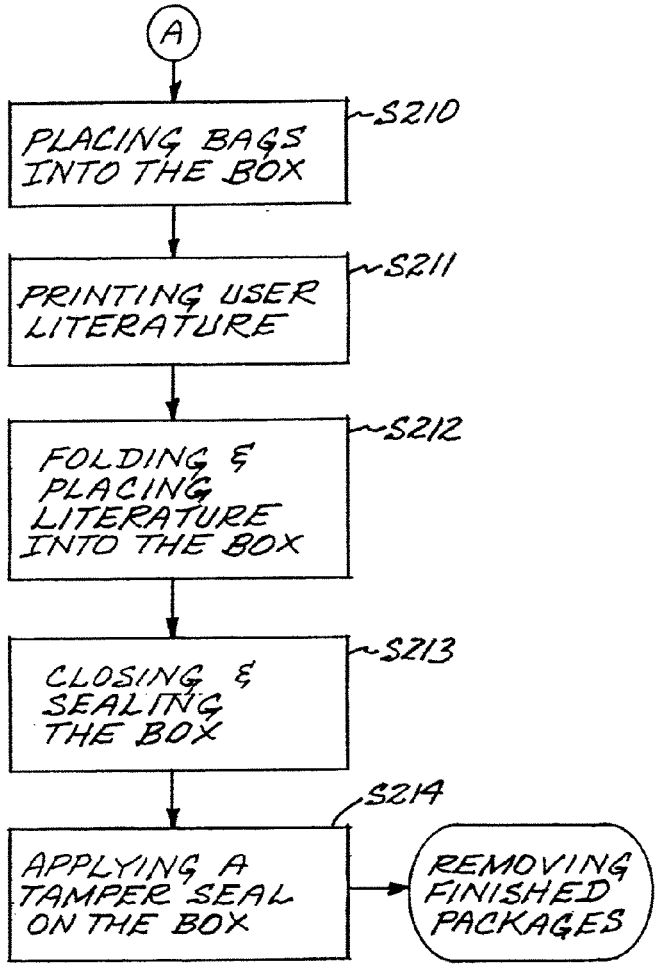

In one embodiment, the functional stations or cells of the packaging system 100 are operationally coupled by a conveyor system. The conveyor system includes three physically separate but functionally integrated conveyers. A first or box conveyer 120 moves the boxes from the box forming station 102, then sequentially to the divider installation station 104, the label applicator 106, the box loading station 118, the literature printing/insertion apparatus 112, the box closer 114, and the tamper seal applicator 116. A second or bag conveyor 122 moves continuous strings of edgewise-connected bags from a bag supply apparatus 124 (such as a reel or a carton), and then sequentially to the bag filling apparatus 108, and to the bag strip cutting station 110. The bag conveyor 122 then takes the cut bag strips (as described below) to the box loading station 118. A third or item conveyer 126 moves items (such as dental aligners) from a supply station 128 to the bag filling station 108. It is assumed that the items are arranged in the supply station 128 in predetermined groups, and within each group, in a predetermined sequence. In the case of dental aligners, each group may correspond to a particular patient, and the sequence within each group may correspond to the order of the dental realignment stages for that patient. This grouping and sequencing may be performed, for example, with the apparatus and system disclosed and claimed in co-pending U.S. application Ser. No. 11/553,330, filed Oct. 26, 2006, assigned to the assignee of the present invention, and the disclosure of which is incorporated herein by reference. The relative placement of the functional stations or cells, as illustrated in FIG. 1, supports the packaging method that is depicted in FIGS. 2A-2C, described below. The speed setting of the conveyor system takes into consideration the throughput of the functional stations or cells, and it is optimized for assuring steady movement of packaging system 100.

The box former 102 may be any conventional, commercially available apparatus for forming boxes from pre-cut sheets of corrugated cardboard. One such apparatus is marketed under the trade name "Cobra" by Doboy, Inc., of New Richmond, Wis. The box former 102 folds and glues precut and preprinted sheets of corrugated cardboard to form rectangular boxes 300 (FIG. 3, described below) with integrally-hinged lids 302, and it places the boxes 300 on the first or box conveyor 120, with the lids 302 open. The cardboard boxes 300 are to be used as outer containers, and are only one exemplary embodiment thereof. Thus, for example, other types of containers, such as metal cans, canisters, and boxes, plastic containers, or even wooden boxes, may be used as outer containers, depending on the type of articles or items to be placed therein. The equipment for manufacturing such outer containers and for forming them (if desired) with two or more inner compartments of suitable configurations and dimensions is commercially available and suggests itself to those skilled in the pertinent arts.

FIGS. 9-15 show the divider installation station 104 (FIG. 1) that may be employed in an exemplary embodiment of the invention in which the cardboard boxes 300 (FIG. 3) are used as the outer containers. The divider installation station 104 includes an adhesive application mechanism 136 (FIG. 9-10) and a divider forming and insertion mechanism 138 (FIGS. 11-15). The adhesive application mechanism 136 employs at least one adhesive spray head 139, and preferably two, as shown in FIG. 9, each of which sprays a strip of adhesive 303 onto the inside bottom surface 301 of each box 300 as the boxes 300 enter the divider installation station 104 on the box conveyor 120. As explained below, the divider forming and insertion mechanism 138 folds cardboard sheets 152 so as to form a vertical dividing wall 304 across the mid-section of each sheet 152. The divider forming and insertion mechanism 138 then places each folded sheet 152 into box 300, where it is fixed to the inside bottom surface 301 by the adhesive 303.

Figure 14:
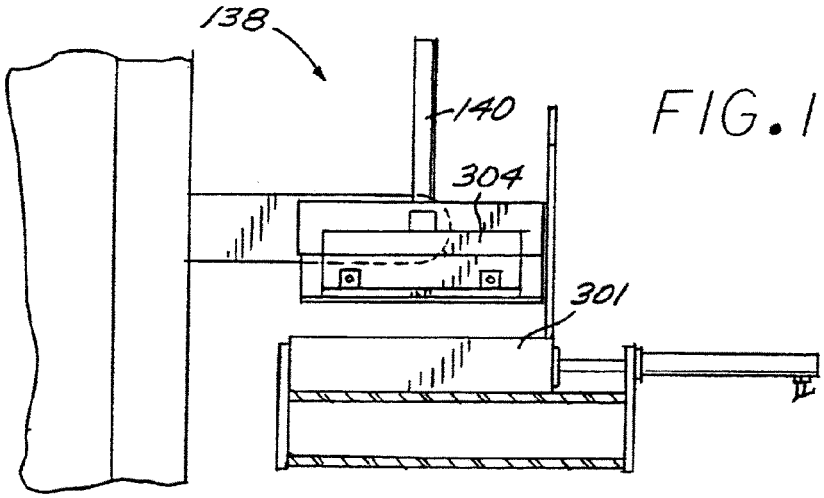
FIGS. 14 and 15 are side elevational views of the divider forming and insertion mechanism, showing the steps of inserting the divider into the box.
Figure 15:
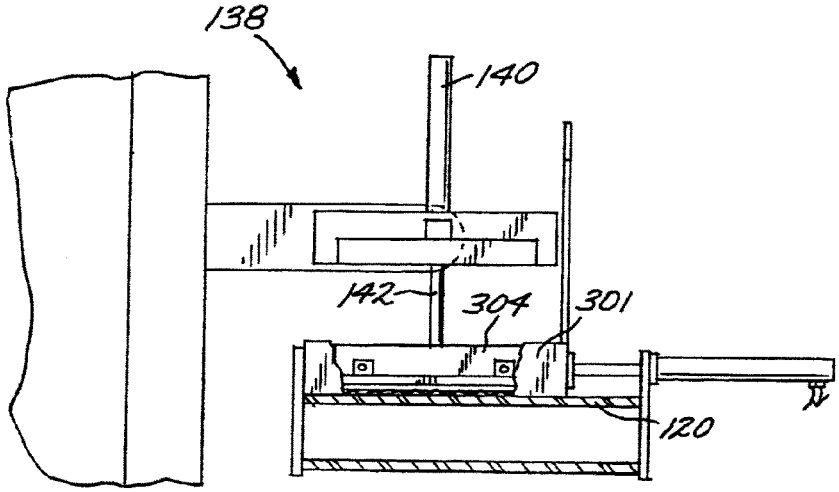
Figure 16:
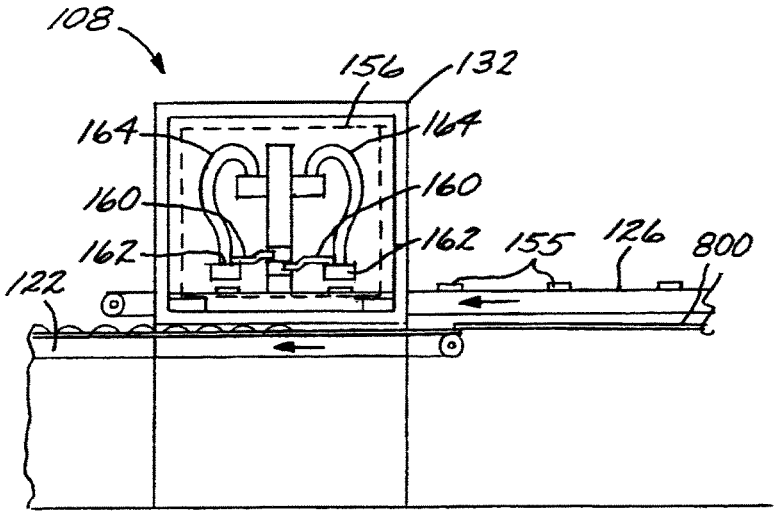
FIG. 16 is a front elevational view of a bagging station employed in an embodiment of the invention.
Figure 28:
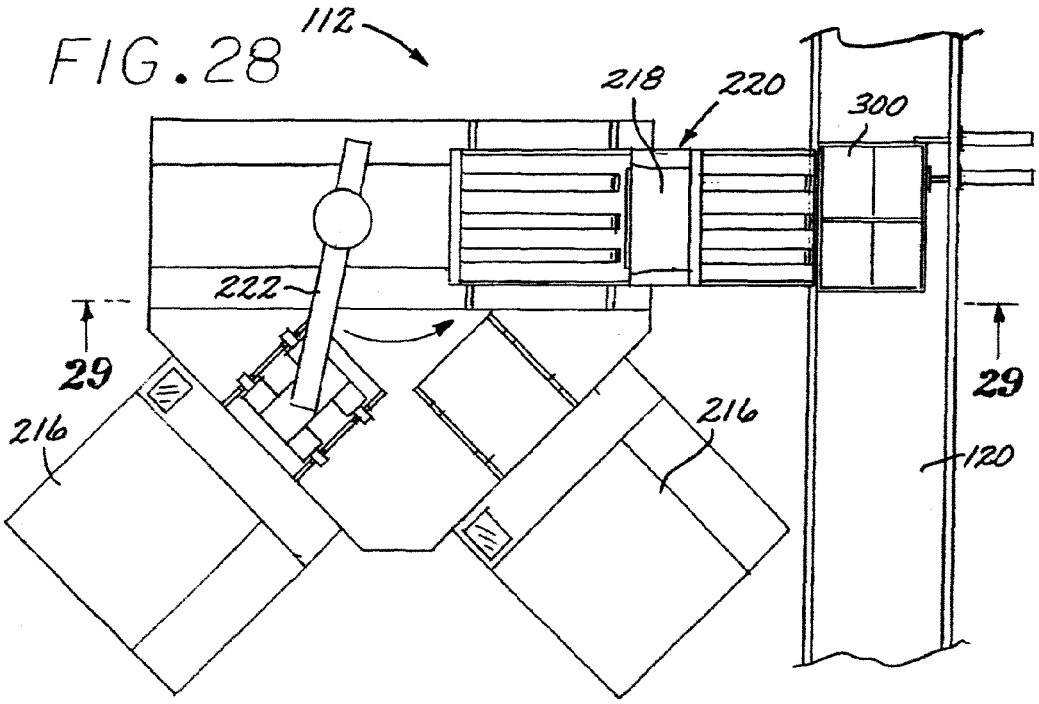
FIG. 28 is a top plan view of a literature printing/insertion station employed in an embodiment of the present invention.
Figure 29:
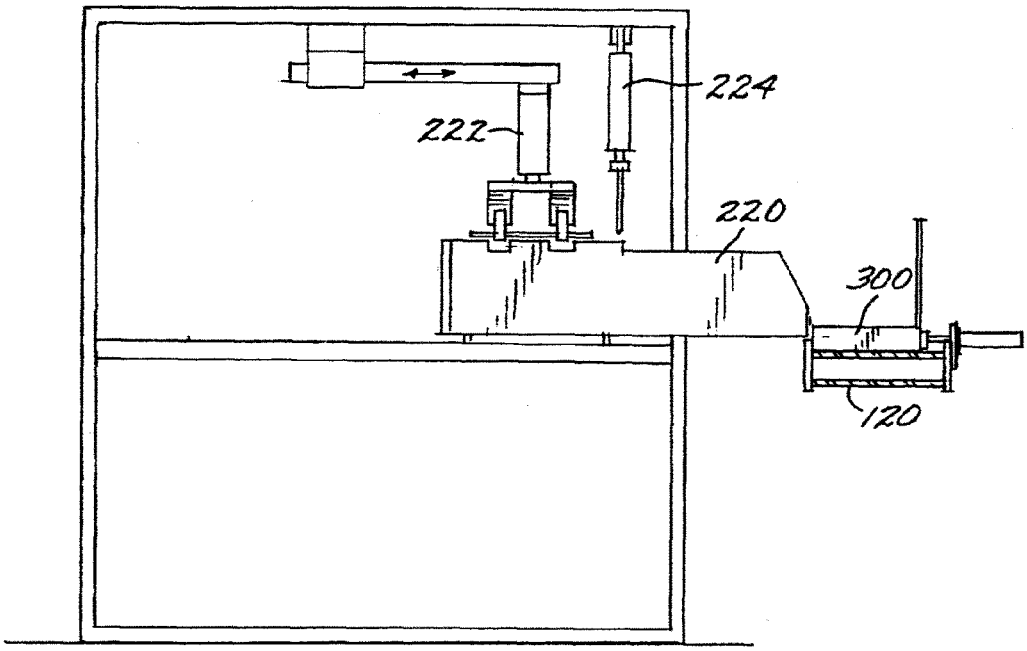
FIG. 29 is a cross-sectional view taken on line 29-29 of FIG. 28, showing the literature folding and insertion apparatus used in the literature printing/insertion station of FIG. 28.
Figure 30:
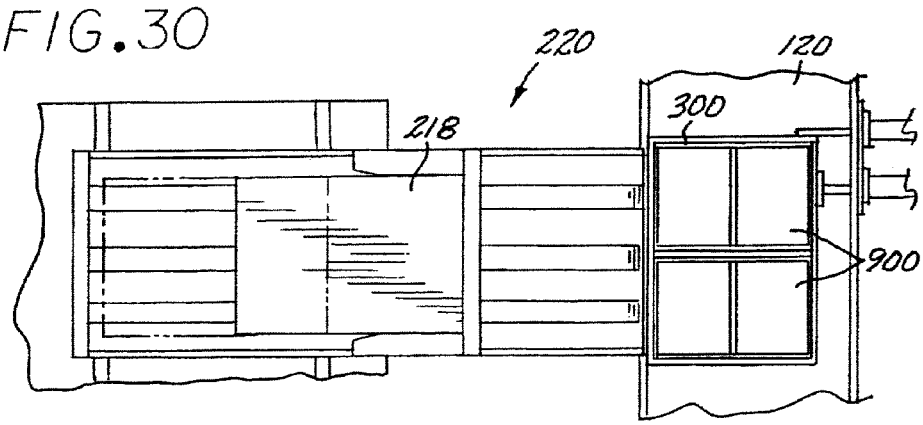
FIG. 30 is a top plan view of the literature insertion apparatus of the printing/insertion station of FIG. 28.

The exemplary divider forming and insertion mechanism 138 used in the present invention includes a pair of pneumatic cylinders 140, each carrying a pneumatic arm 142 having a vacuum-actuated sheet-holding element 144 fixed to its end. The cylinders 140 are movable laterally between an open position (FIGS. 11 and 12) and a closed position (FIG. 13), while the arms 142 are movable pneumatically within their respective cylinders 140 between a vertically withdrawn position and a vertically extended position to move the arms between a raised and a lowered position, respectively. The divider forming and insertion mechanism 138 also includes a reciprocating plunger 150 having an upwardly-extending blade 154. The plunger 150 is movable between a lowered position (FIGS. 11 and 13) and a raised position (FIG. 12). As shown in FIG. 11, with the arms 142 in their vertically withdrawn or raised position, and the cylinders 140 in their laterally open position, a cardboard sheet 152 is fed to the arms 142, and the sheet 152 is held thereto by means of suction applied to the holding elements 144. When the sheet 152 is in place, the plunger 150 is raised (e.g., electrically or pneumatically) to bring the blade 154 to bear against the sheet 152 while the cylinders 140 move toward each other to their closed position, as shown in FIG. 12. As shown in FIG. 13, the blade 154 is withdrawn by lowering the plunger 150, while the cylinders 140 continue to move toward each other to their closed position, thereby completing the folding of the sheet 152 to form the divider 304. As shown in FIGS. 14 and 15, the arms 142 are then moved from their withdrawn or raised position to their extended or lowered position to insert the divider 304 into the box 300. The divider 304 thus divides the box 300 into two compartments 308 of approximately equal size, as shown in FIG. 3.

It will be understood that in other embodiments of the invention, in which outer containers other than the cardboard boxes 300 are used, the outer containers may be divided into two or more inner compartments of suitable configurations and dimensions to hold whatever specific items or articles are to be contained in the outer containers. The apparatus to manufacture such internally-divided or compartmentalized outer containers is commercially available and will readily suggest itself to those skilled in the pertinent arts. Furthermore, for many types of items, division of the outer container into compartments may not be necessary or desirable, in which case the divider installation station 104 may be omitted altogether.

Figure 3:
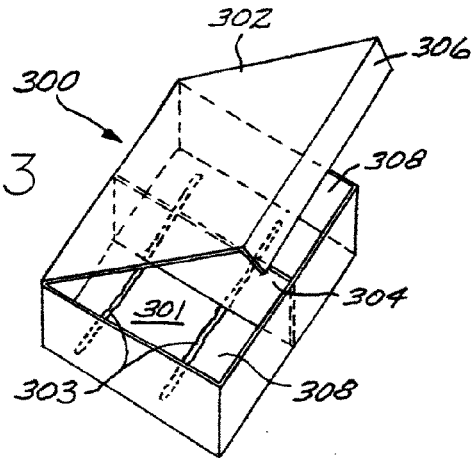
FIG. 3 is a perspective view of an exemplary cardboard box having a divider, the box being of the type used in an embodiment of the present invention.

FIG. 3 shows a completed box 300 as it appears after leaving the divider installation station 104. The box 300 has a bottom interior surface 301 to which a divider 304 is secured by means of the adhesive or glue strips 303 applied by the adhesive application mechanism 136 of the divider installation station 104, as described above. As shown, the box lid 302 may advantageously be provided with a sealing flap 306 on its free end.

The box label applicator 106 may be any suitable label application machine that is commercially available from a number of sources, such as the Model 2000 or Model 2000e marketed by Panther Industries, Inc. of Englewood, Colo. The box label applicator 106 prints and attaches a unique identification (ID) label (not shown) to each box 300. The label may include information in both alphanumerical and barcode format. For dental aligners, the information may include the patient's name and a unique ID number, the number of aligners contained in the box, the number of boxes for an entire treatment for that patient, and treatment details for the aligners contained inside the box. The label information is obtained via a local area network (LAN) from a database in a computer system, of the type to be described below. Label applicators for outer containers other than cardboard boxes, as described above, are likewise commercially available and may be selected as appropriate for each particular type of outer container. Alternatively, for some types of outer containers, it may be advantageous or necessary to apply the required identification information to the outer containers by directly printing it on them.

The present invention contemplates the packing of the items in inner packs that are ultimately loaded into outer containers, such as the cartons or boxes 300 described above. In an exemplary embodiment, the inner packs are plastic bags, preferably (but not necessarily) provided, supplied, and processed in a continuous interconnected string through the filling procedure described below. Alternatively, the inner packs may be plastic cases, shrink-wrap packs, paper bags, paper envelopes, glassine envelopes, cardboard envelopes, cardboard boxes, or any other type of pack that is suitable for the particular type of item to be packaged.

An exemplary embodiment employs plastic bags connected in a continuous string, and the bag supply apparatus 124 provides the continuous string of bags connected together from a conventional dispensing mechanism (not shown), such as a carton, a reel or a drum. A portion of an exemplary bag string 800, in accordance with an embodiment of the invention, is shown in FIG. 6, wherein the string 800 is a continuous edge-wise connected bag string, comprising a multiplicity of individual bags 802 connected by heat seams 804 along their lateral edges. Each bag 802 has an open end 806, defined between a pair of side walls 807 (FIG. 22), through which a mass-customized item can be inserted into the bag (as described below), and a closed end 808, the ends 806, 808 being transverse to the lateral edges along which the heat seams 804 are formed.

An alternative bag string configuration is shown in FIG. 8, wherein a continuous end-to-end connected bag string 800A includes a multiplicity of individual bags 802A, each bag having opposed first (upper) and second (lower) ends, with the first or upper end of each bag being joined to the second or lower end of the next adjacent bag along a frangible seam 812. Each bag 802A has a slotted opening 810 parallel to its first or upper end, through which a mass-customized item may be inserted into the bag 802A, after which the bags are sealed (as described below).

FIGS. 16-24 illustrate the various operational mechanisms and features of the bagging station 108, showing the several steps of the bagging process that is a part of the method of the present invention. As shown in FIGS. 16-24, the bagging station 108, which receives a continuous bag string 800 via the bag conveyor 122, includes a bag printer 130, a bag filler 132, and a bag sealer 134 (see FIG. 1). The bag printer 130 prints customer specific information on each bag 802 while the bags are empty. The bag printer 130 may be any conventional printing device capable of printing or otherwise marking the bags, for example, an inkjet printer, laserjet printer or the equivalent. The bag inscription may include information in both alphanumerical and barcode format. For dental aligners, the information may include the patient's name, order details, the prescribing doctor's name, specific aligner information known as interproximal reduction (IPR) information and pontic information, the upper (U) aligner stage number, the lower (L) aligner stage number, a "notes" field, and the packing date. The information for the bag inscription is accessed from a computer database via a local area network (LAN), which is described below. Also, as will be seen, the information printed on each bag relates to the specific items to be placed in the bag by the bag filler 132.

The mass-customized items to be packaged are delivered by the third conveyor 126 to the bag filler 132. In a specific exemplary embodiment of the invention that is employed for the packaging of dental aligners, the items are advantageously delivered in individual item carriers or "pucks" 155. Each puck 155 is provided with an RFID chip (not shown) that identifies the item contained in the puck, and that is read by an RF reader (not shown) that conveys the ID information to a computer database accessed via the LAN. Alternatively, the items may themselves carry an RFID chip or be marked with an optically-scanned barcode or unique symbol, thus obviating the need for an RFID carrier or puck. By whatever means are used to identify individual items upon delivery to the bag filler 132, each item is identified by its proper group, and (if the items have been ordered in a predetermined sequence) by its sequential place within the group.

In the case of dental aligners, for example, each group may correspond to a particular patient, and the sequential place may correspond to the dental alignment stage for that patient. The identifier may also (in the case of dental aligners) indicate whether the aligner is an upper or lower aligner, and may include other information as appropriate. Accordingly, when the items in the pucks 155 are conveyed to the bag filler 132, they have already been sorted by group and ordered in the proper sequence in each group. Moreover, each item is matched to a printed or inscribed bag assigned to that item by means of the computer system, as described below.

Specifically, as each bag enters the printer 130, it is assigned by the computer system to be filled by one or more specific items. The computer system thus coordinates the printer 130 with the bag filler 132 by means of the information read from each RFID puck 155, whereby each bag is printed with the specific information relating to the specific items to be placed in the bag. Thus, as the item from each puck 155 is deposited in the bag filler 132, as described below, a bag that has been appropriately printed for the item or items assigned to it is positioned in the bag filler 132 to receive the assigned item or items. Accordingly, if the pucks 155 contain the items sorted into predetermined groups and ordered within each group in accordance with a predefined sequence, the bags will be printed and filled in accordance with the same groupings and sequences.

The bag filler 132 may advantageously include a commercially available "pick and place" machine 156 (See FIG. 16) and an insertion mechanism 158. The pick and place machine 156 picks the mass-customized items out of the pucks 155 on the third conveyor 126 and delivers them to the insertion mechanism 158 (described below and illustrated in FIG. 18). The pick and place machine 156, which is of conventional design, typically includes a pair of controllably-movable arms 160, each terminating in a vacuum pick-up head 162 connected by a flexible hose 164 to a vacuum source (not shown). The arms 160 are pivotably connected to a rod or piston 165 that is vertically movable between upper and lower positions within a pneumatic cylinder 166.

As shown in dotted outline in FIGS. 17 and 18, the pick and place arms 160 pivot about a vertical axis from a pick-up position with the rod or piston 165 in its upper position (solid outline in FIG. 18) to a deposit position with the rod or piston 165 in its lower position (dashed outline in FIG. 18). In the deposit position, the arms place each item (such as a dental aligner 902) on a receiving bed or tray 168 of the insertion mechanism 158. As best shown in FIGS. 19 and 20, once deposited on the receiving bed or tray 168, the item 902 is pushed by a pusher plate 170 into a central loading channel 174, where it awaits the positioning of a bag 802 into a bag opening mechanism 180. If each bag is to receive two items 902, it is advantageous to have each of the two items deposited on a respective receiving tray or bed 168 in its desired orientation, with the items then being pushed into the loading channel 174, properly positioned and oriented for insertion into a bag, as described below. Advantageously, if each bag is to contain a pair of items (as is typically the case with dental aligners), both items in each pair are cleared from the channel 174 (i.e., loaded into a bag, as described below) simultaneously.

Before each bag is opened by a bag-opening mechanism, as described below, the information printed on each bag 802 is read by a scanner (not shown), such as a barcode scanner, and fed to the computer system via the LAN. The RFID information from each puck (which includes item identification information unique to that item) is read by an RFID reader (not shown), which transmits the RFID information to the computer system for verification against the information scanned from the bag to assure that each item is to be inserted into its properly assigned bag (i.e., the RFID puck information relating to the items is matched to the bag information).

The bag opening mechanism 180, which is part of the insertion mechanism 158, is illustrated in FIGS. 21-23. It includes a vacuum head 182 on the end of a vertically reciprocating arm 183 (FIGS. 17 and 21) that is movable between raised and lowered positions. When the arm 183 is lowered, the vacuum head 182 engages one side wall 807 of an unsealed bag. Vacuum is then applied to the vacuum head 182, causing it to grip the bag 802, whereby raising the arm 183 opens the bag 802 to facilitate the insertion of the desired number of items 902 into each bag 802 as it is positioned to receive the item or items designated for that bag by the computer system described below. Once the bag is pulled open by the vacuum head 182, a pair of bag spreading fingers 184 are inserted into the open end 806 of the bag 802 by a pair of rotating cams 186, as shown in FIG. 21. The fingers 184 spread the side walls 807 of the bag apart and maintain their separation, as shown in FIG. 22, to facilitate the insertion of the items. With the bag 802 fully opened by the vacuum head 182 and the fingers 184, the item or items 902 in the channel 174 is/are pushed into the open end 806 the bag 802 by a ram 188 (FIG. 23). In the case of dental aligners, the upper and lower aligner pair for a single stage of dental realignment will be assigned to, and inserted into, a single bag, so that bag remains open at the insertion apparatus while both items of the assigned pair are loaded into it. Furthermore, in the case of dental aligners, the bags are filled by group (e.g. dental aligner patient) and in the proper defined sequence (dental realignment stages) in each group. Once the items are inserted into the bag, the vacuum is shut off from the vacuum heads 182, and the bag is released as the arms 183 are raised.

If the alternative bag string configuration shown in FIG. 8 is used, the bag filler 132, and particularly the insertion mechanism 158 and the bag opening mechanism 180, must be modified so as to allow the items 902 to be inserted into the bags 802A through the slotted openings 810. Such modifications will readily suggest themselves to those skilled in the pertinent arts.

It will be appreciated that various bag-filling mechanisms that are functionally equivalent to the specific bag filler 132 described herein may suggest themselves to those skilled in the pertinent arts. Furthermore, it may be desired to provide the bags individually or separately, rather than in interconnected continuous strings, and the modifications needed to fill separate bags will also readily suggest themselves. Moreover, as mentioned above, instead of plastic bags, the inner packs may be any other suitable packaging or packing medium known in the art, and the apparatus or equipment required to fill and to close or seal such alternative inner packs is available commercially and may be readily substituted for the specific exemplary bag filler 132, as would be the equipment needed to provide the required identifying information on the inner packs, either by directly printing it on the inner packs themselves, or by printing it on labels affixed thereto. Finally, as alluded to above, although it is contemplated, in the preferred embodiment described herein, that the items have been ordered in a predetermined sequence, such ordering may not be necessary for many types of items, such as protective wear, prosthetics, and implantable hearing aids. In that case, of course, the information provided on the item or the puck (by means of an RFID chip, identifying indicia, a barcode or the like) may contain any ordering or sequencing information, and thus, each item may simply be inserted into the next inner pack available.

Again, referring to the specific exemplary embodiment, after each bag 802 is filled, it is moved to the bag sealer 134 (FIGS. 17 and 24), where the open end 806 (See FIG. 6) is sealed by a sealing head 190 to form a seal 904 across the top of each bag. The sealing head 190 may perform the sealing by conventional heat-sealing, sonic welding, or any suitable equivalent known in the art. The sealing head 190 is advantageously carried on the end of a vertically reciprocating arm 192 that allows each bag respectively to enter and leave the bag sealer 134 before and after the sealing function is performed.

If the alternative bag string configuration of FIG. 8 is used, a first seal 904A is advantageously formed in each bag 802A below and parallel to the slotted opening 810, and a second seal 904B may advantageously be formed just above and parallel to the frangible seam 812.

As mentioned above, the bags 802 emerge from the bag supply station 124 and enter the bagging station 108 in a continuous, edge-wise connected bag string 800. The bag cutting station 110, as shown in FIGS. 25-27, includes a bag string feeding mechanism 194 and a strip cutting mechanism 196. The feeding mechanism 194, under the control of the computer system described below, determines the number of bags that are assigned to each predetermined group (e.g. a dental aligner patient). Each group will comprise a predetermined number of bag strips, each comprising no more than a predefined maximum bag number. The feeding mechanism 194 thus further determines, under the control of the computer system, the number of bags that are to be in each successive strip, and then feeds the requisite number of bags to the cutting mechanism 196, to be described below.

The feeding mechanism 194, as best shown in FIG. 26, includes a pair of nylon bag-engaging dowels 198 extending downward from a carriage arm 204 at the end of a rod or piston 200 that is vertically movable between a raised position and a lowered position within a pneumatic cylinder 202. The carriage arm 204 is movable parallel to the longitudinal axis of the bag string 800, as shown by the double-headed arrow 206 in FIG. 25. The carriage arm 204 is maintained at a first limit of travel (with the greatest distance to the cutting mechanism 196, or at the right-most limit, as shown in FIG. 25), with the arm 204 and the dowels 198 in their raised position, and then the arm 204 and the dowels 198 are lowered by the piston or rod 200 to bring the dowels 198 into a frictional engagement with a bag 802, as shown in FIG. 26. The carriage arm 204 is then translated toward its other limit of travel (at a minimum distance from the cutting apparatus 196, or leftward, as shown by the arrow 208 in FIG. 26). The lateral travel of the carriage arm 204 is determined by the width of the bag 802, and is normally two bag widths. The barcodes printed on the bags are scanned by an optical scanner or barcode reader (not shown) to verify that the bag string 800 is to be cut at the appropriate place when the requisite number of bags is pushed through the cutting mechanism 196, as discussed below.

The feeding mechanism 194 is controlled, via the LAN, by means of a programmable logic controller (PLC) in the computer system, as described below. As discussed above, the bags are filled by predetermined group and ordered in the predefined order within each group. The feeding mechanism 194 is controlled by ID information communicated, via the LAN, whereby the feeding mechanism 194 feeds the bags in each group, properly sequenced, to the cutting mechanism 196. In some cases, a group may comprise more bags than a predetermined maximum number, such as the number that can fit into a single box compartment 308 (see FIG. 3). When this maximum number, which may be designated a "strip limit," is fed through the feeding mechanism 194, the feeding mechanism stops. Thus, the feeding mechanism 194 will feed all the bags in a predetermined group if the number of bags in a group is no more than the strip limit, or in subgroups each having no more than the strip limit if a group has a number of bags exceeding the strip limit.

The cutting mechanism 196 cuts the bag strings 800 into strips 900. Each strip 900 comprises the bags in a single group. If the number of bags in the group does not exceed the strip limit, the strip 900 will include all the bags in the group. If the number of bags in the group exceeds the strip limit, the bags in the group will be divided into two or more strips 900, each having a number of bags not exceeding the strip limit. (For the purpose of this discussion, it will be appreciated that a "bag strip" may comprise only a single bag.) The cutting mechanism comprises a cutting head 210 in which are mounted a retention element 212 and a reciprocating cutting blade 214. The cutting head 210 can be raised to allow the requisite number of bags in a predetermined strip 900 to pass through, and then it is lowered to bring the retention element 212 into contact with next bag after the last bag in a predetermined strip 900. At this point, the cutting blade 214 is lowered to sever the edge-wise connection between the two bags on either side of the blade, along the edge-wise seam 804. If the alternative bag string configuration of FIG. 8 is employed, the cutting occurs along the frangible seams 812. The actions of the cutting mechanism 196 are coordinated with those of the above-described feeding mechanism 194, whereby the feeding step of the latter is performed while the cutting head 210 and retention element 212 are raised; and when the cutting step is performed by the former, the carriage arm 204 of the feeding mechanism 194 is returned to its original position at its first limit of travel.

As shown in FIG. 7, each strip 900 comprises an edgewise-connected plurality of bags 802, wherein the contiguous bags 802 in each strip 900 belong to a predetermined group and are connected in the predetermined sequence. If a group includes more than a predetermined maximum number of bags (i.e., the strip limit, as defined above), the group is divided into two or more subgroups, each making up a bag strip 900 with no more than the maximum bag number. Thus, the cutting apparatus 110 (comprising the feeding mechanism 194 and the cutting mechanism 196 of FIGS. 25-27) is fed data from the computer system, via the LAN, to control the length of each strip 900; that is, how many bags 802 are in each group, wherein each strip 900 comprises one predefined group (or subgroup). In a specific exemplary embodiment of the invention, the strip limit is determined by the filled bag capacity of each compartment 308 in the box 300, which in this embodiment is twelve item-filled bags.

FIG. 7 shows a cut strip 900 of six bags 802, each of which has been filled with the desired number of mass-customized items. In an exemplary embodiment in which the mass-customized items are dental aligners, each bag 802 receives at least one dental aligner 902, and preferably two dental aligners 902, as shown. The orientation of aligner 902 in bag 802 may be determined so as to minimize the size of bag 802 or maximize the number of aligners contained in bag 802. A skilled artisan will appreciate that no specific orientation of aligner 902 is required for the broadest application of the invention. Typically, the aligners 902 in each bag are the upper and lower aligner pair for a single stage of dental realignment, and the bags are filled by group (e.g. dental aligner patient) and in the proper defined sequence (dental realignment stages) in each group. The bags 802 are shown after having been sealed, and thus a seal 904 is formed just below what had been the open bag ends 806.

Once the bag strips 900 are cut, they are fed by the bag conveyor 122 to the box loading station 118. At the box loading station 118, the filled, sealed, and cut bag strips 900 are manually loaded into the boxes 300 conveyed thereto on the box conveyor 120. Data on the bag inscriptions are matched with data on the box labels, via a barcode scan of the box and the bag with a barcode scanner (not shown), to assure that each box 300 contains only those bag strips 900 belonging to the proper predetermined group. The bag strips 900 are loaded into the box 300 by manual fan folding along their edgewise seams 804, with the bags 802 in a predefined sequence. For aligners, the sequence is normally one in which the bags 802 are loaded in the reverse order of the stage, from bottom to top. If a bag group contains more than the maximum number of bags that can fit in a single box 300, bag strips 900 corresponding to one or more subgroups may be loaded into a second or third box, etc.

Figure 31:
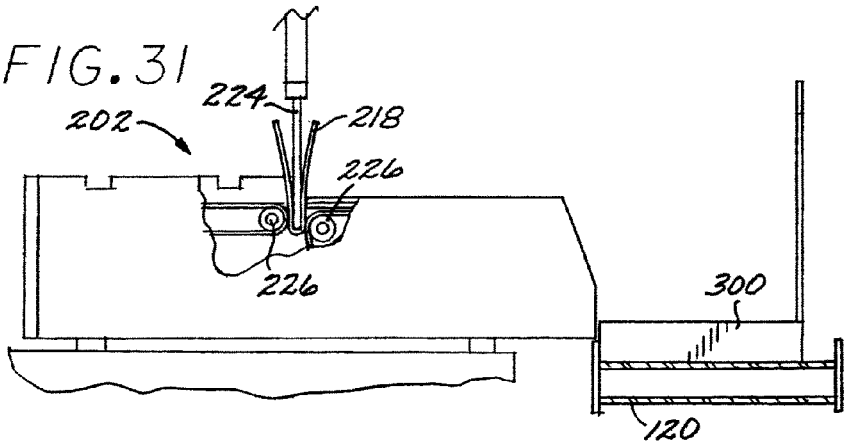
FIGS. 31 and 32 are side elevational views of the literature insertion apparatus showing the steps of folding the literature and inserting into a box.
Figure 32:
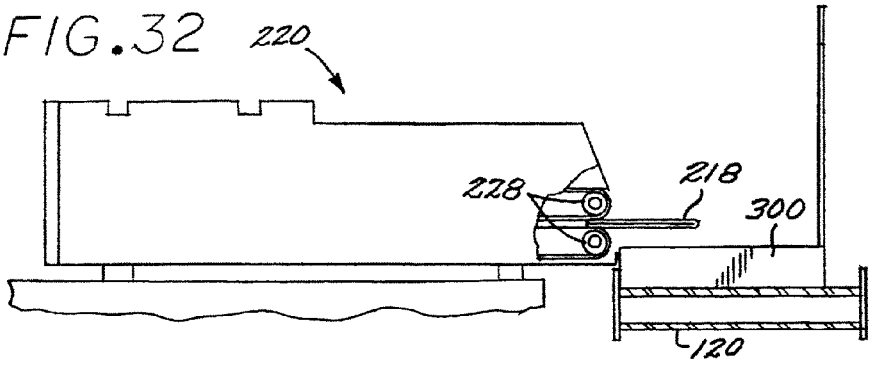

The literature printing and insertion station 112 (FIGS. 28-32) includes one or more printers 216 (preferably, but not necessarily, laser printers) that print one or more patient-specific literature sheets 218 for each patient, based on a scanned or stored patient ID obtained from the computer system via the LAN. The printing and insertion station 112 also includes a literature insertion mechanism 220 that folds and inserts the literature sheet or sheets 218 into the appropriate box or boxes containing the aligners for that patient. The literature insertion mechanism includes a pivoting robot arm 222 that picks up the literature sheets 218 from the printer(s) 216 and delivers them to the literature inserting mechanism 220, where, as shown in FIG. 31, a plunger 224 pushes the literature sheets 218 between a first pair of pinch rollers 226 that fold the literature sheets 218. As shown in FIG. 32, the folded literature sheets 218 are then fed into the appropriate box 300 through a second pair of pinch rollers 228 as the boxes pass by on the box conveyor 120.

Following the insertion of the literature, the boxes are closed and sealed by the box closing apparatus 114, which may be any suitable commercially-available device, such as, for example, the Doboy, Inc. Model 803E. Finally, a tamper seal applicator 116, such as the type that is commercially available from Panther Industries, Inc., places a tamper seal on the closed box.

In another aspect of the present invention, a packaging method is provided, as illustrated in FIG. 2A. The method 200, in accordance with an embodiment of the invention, includes in step s222 creating a database including a plurality of item identification information. For example, the database may include, but is not limited to, (a) item identification information unique to each mass-customized item, (b) item grouping information identifying a predefined group of items to which each unique item belongs, and (c) item sequencing information defining a predetermined sequence for the items in each group.

Once the database is created the item identification information is available to be applied via a computer system or the equivalent processing means to various containers and inner packs.

In step s224, outer containers are provided. Each outer container of a plurality of outer containers is associated with item identification information from the database.

In step s230, the outer containers are matched and filled with at least two items. The items placed in the outer pack are associated with the outer pack by the item identification information. Each item represents a uniquely configured item and the items order of placement in the outer packs is related to a sequence of use. Thus, each outer container may be presented for loading with one or more, preferably two or more, distinct items.

In an alternative embodiment, steps s226 and s228 may be included in manufacturing method 200. In this alternative embodiment, in step s226, inner packs are provided and are associated with item identification information from the database. In step s228, each inner pack of the plurality of inner packs may be filled with at least one item, preferably two items. The items placed in the inner pack are associated with the inner pack by the item identification information. Each item represents a uniquely configured item and the items order of placement in the series of inner packs is related to a sequence of use. The inner packs are loaded into outer containers having corresponding item identification information.

In another aspect of the present invention, packaging method 200 is provided in more detail, as illustrated in FIGS. 2B and 2C. The method 200, in accordance with an embodiment of the invention, includes the following steps: forming an outer container as shown in FIG. 9 (e.g., box 300 in FIG. 3) (step S201); creating a divider 304 (step S202); printing and affixing of an ID label to the box 300 (step S203); printing identifying indicia on each of the inner packs (e.g. bags 802) in a continuous string 800 of bags supplied from a bag supply apparatus 124 (step S204); filling the bags 802 with mass-customized items (e.g., dental aligners 902) sorted by predefined groups and ordered in a predetermined sequence within each group (steps S205, S206, S207); sealing the bags 802 (step S208); feeding and cutting the bag strings 800 into bag strips 900 corresponding to predefined groups or predefined sub-groups (step S209); placing the bag strips 900 into the corresponding boxes 300 (step S210); printing folding and inserting user (e.g., patient) literatures into the boxes 300 (steps S211, S212); closing and sealing the boxes 300 (step S213); and applying tamper seals on the boxes (step S214). Between the processing steps, the boxes, bags, and mass-customized items (e.g., aligners) are moved by the above-described conveyer systems.

In step S201, as discussed above, a precut and preprinted sheet of corrugated cardboard is folded and glued to form a rectangular box 300. The newly formed box 300, with an open lid 302, is placed on the box conveyer 120, exposing the inside bottom surface 301. The box conveyer 120 delivers the open box 300 to the divider insertion station 104, at which, in step S202, adhesive 303 is applied to the inside bottom surface 301 of the open box 300, while at the same a precut flat sheet of cardboard is folded into a divider 304. The divider 304 is then fixed to the inside bottom surface 301 of the open box 300 by means of the adhesive 303, thereby creating two equal compartments 308 (FIG. 3). The box 300 with the divider 304 is moved by the box conveyer 120 to the labeling station 106. Here, in step S203, an ID label is printed and affixed to the box 300. The label includes user specific information about the contents of the box 300, as discussed above. The information is provided by a computer system (described below) via a local area network (LAN).

In step S204, user specific information is printed on the plastic bags 802. Each bag 802, at this point, is part of a continuous string 800 of bags. Again, the information printed on the bags 802 is provided by the computer system described below via a LAN. The PLCs of the computer system, via barcode scanning at several points in the process (as described above), coordinate the movements of the boxes, bags, and items to be packaged in the packaging system 100. Furthermore, the computer system provides information on how the mass-customized items to be packaged are to be grouped (by patient, for example, in the case of dental aligners), and how they are to be sequenced within each group. This information is sent to the box labeling station 106 for performing the box-labeling step S203, and to the bag printer 130 in the bagging station 108 for performing the bag-printing step S204.

In the bagging procedure (steps S205, S206, S207), the mass-customized items, having been presorted (by group) and sequenced (within each group), are supplied to the bagging station 108 by the third conveyor 126, advantageously in individual RFID holders or "pucks" 155. As mentioned above, the bagging station 108 includes a printer 130 for printing the bags 802 (step S204), and a bag filling apparatus 132 that includes a pick and place machine 156 for removing the items from the third conveyor 126 (in Step S205), one or two at a time, based on information received via the LAN. The bag filling apparatus then opens each bag 802 (step S206) and inserts the appropriate items (per information received from the LAN) into each bag (step S207). In the case of dental aligners, each bag will typically contain two aligners 902 (upper and lower) for each stage of dental realignment for each patient, as shown in FIG. 7. Alternatively, it may be desired to include only a single aligner 902 in each bag 802. The bags are then sealed, as described above, in step S208.

In step S209, the continuous string 800 of bags is cut into predetermined bag strips 900 containing a predetermined number of edgewise-connected bags 802. The number of bags 802 in each strip 900 corresponds to the number of bags 802 assigned to each predetermined group or subgroup, as described above, in accordance information provided by the computer system via the LAN. The bags 802 in each cut strip 900 are connected and ordered in a predefined sequence. Thus, each strip 900 contains bags 802 belonging to the same predefined group or subgroup, and within each group, the bags 802 are sequenced in the proper order. In the case of dental aligners, the bags 802 in each strip 900 contain the aligners 902 of a single patient, and within each strip 900, the bags 802 are sequenced in accordance with the stages of dental realignment for that patient.

As an alternative embodiment, the bags may be filled before they are printed. In that case, the identification information associated with each item is read before it is inserted into the next available bag. The information so read is conveyed by the LAN to the computer system, which directs a label printing apparatus to print a label with the identification information (in alphanumeric and barcode formats) that is applied to each filled bag. The apparatus to perform the bag label printing and application functions is conventional and commercially available, and need not be described in detail for the purposes of this disclosure.

Following the cutting step, in step S210, the filled and cut bag strips 900 and the empty boxes 301 arrive at the box loading station 118. After it is determined that the ID information for a filled bag strip 900 matches the ID information for a box 300, the bag strip 900 is fan-folded and placed manually by an operator into the empty box 300. The matching of bags 802 and boxes 300 may be assisted by indicator-lights (not shown) that are operated in response to barcode scanner reading of the box label and the bag inscription. The bag strips 900 are folded so that the bags are sequenced in reverse order from the bottom of the box to the top. Each of the two compartments 308 of the box 300 contains a single strip 900. Therefore, the maximum number of bags in each bag strip 900 (i.e., the above-mentioned "strip limit") is the number of filled bags 802 that will fit into each box compartment 308.

In step S211, user or patient literature is printed on one or more sheets of paper, with information pulled from the corresponding file in the LAN database and provided to the printer or printers 216. In step S212, the literature sheets 218 are folded, and then deposited into each open box 300. In step S213, each box 300, containing the requisite number of filled bags 802, is closed and sealed. In step S214, a tamper seal may advantageously be applied to each box.

It will be appreciated, as discussed above in connection with the description of the system of the invention, that the method or process of the invention encompasses the use of outer containers other than cardboard boxes or cartons, and that the internal dividers may be provided by any means suitable to the particular type of outer container, or even omitted altogether. As also discussed above, the inner packs may be separate and discrete units that are labeled (either by direct printing or by means of printed labels affixed thereto) and filled individually. Such alternative inner packs may be, for example, plastic cases, cardboard boxes, and bags and envelopes of various materials. With such alternative inner packs, there would be no need for a separation or cutting step, as in the case of bag strings, and filling the inner packs may or may not require discrete opening and/or sealing steps, depending on the type of inner pack used. In other words, the method of the invention encompasses the use of a wide variety of inner packs, and the modifications of the method necessary to accommodate each type of inner pack will readily suggest themselves to those skilled in the pertinent arts. Furthermore, as also discussed above, the items, and therefore the inner packs, may not necessarily be required to be ordered in any particular sequence within each group. The above-described method may be readily adapted to such non-sequential inner pack filing and outer container loading without departing from the spirit and scope of the present invention.

Figure 4:
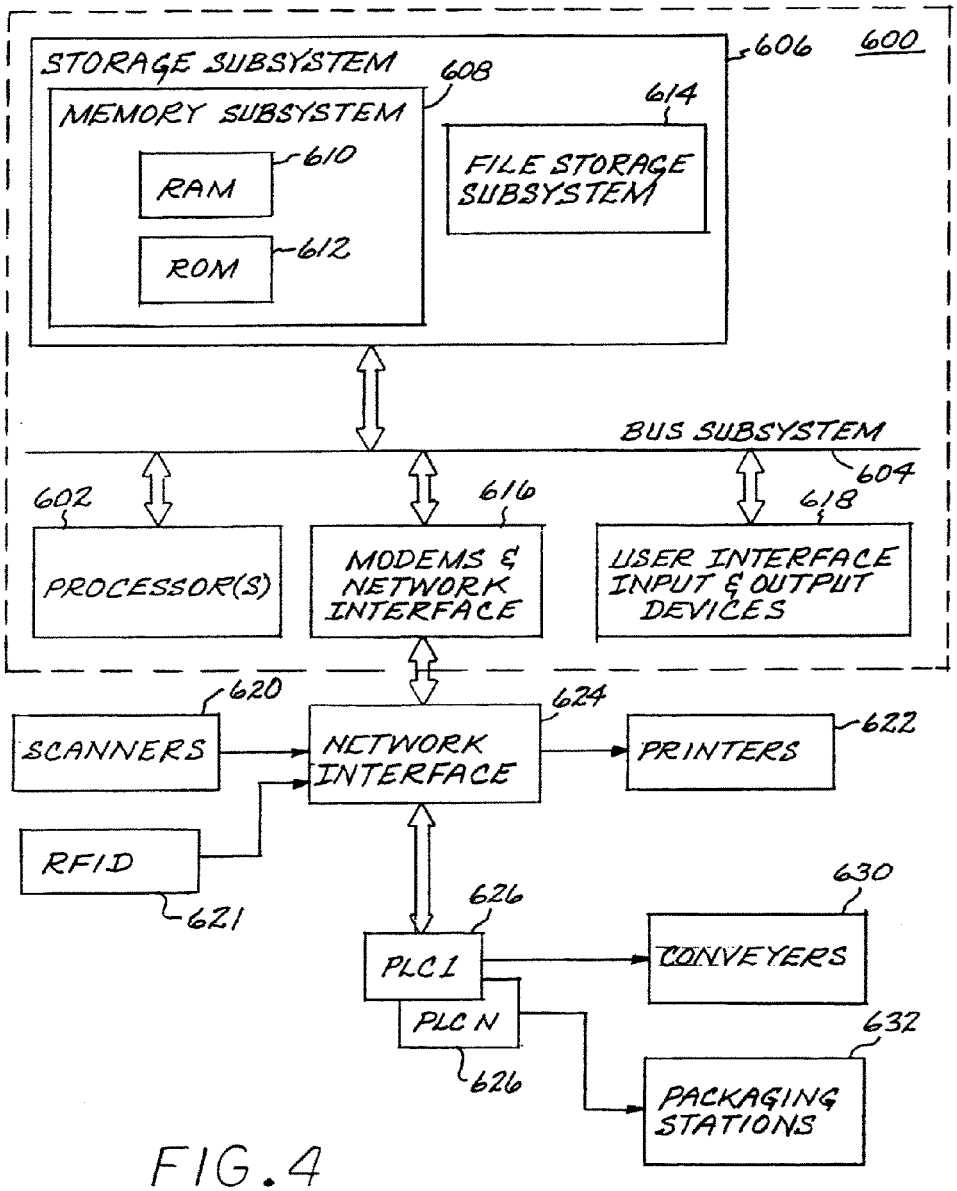
FIG. 4 shows a block diagram of a computer system that controls the packaging system of the present invention.

FIG. 4 shows a simplified block diagram of a data processing system or computer system 600 that may be used to provide overall control of the packaging system 100. The computer system 600 typically includes at least one processor 602 that communicates with a number of peripheral devices via a bus subsystem 604. These peripheral devices typically include a storage subsystem 606 (memory subsystem 608 and file storage subsystem 614), a set of user interface input and output devices 618, and an outside network interface 616, including the public switched telephone network. This interface is shown schematically as "Modems and Network Interface" block 616, and is coupled to corresponding interface devices in other computer or data processing systems via a communication network interface 624, which includes an interface with the local area network (LAN). The computer system 600 may be a terminal or a low-end personal computer, or a high-end personal computer, workstation, or mainframe.

The input devices in the user interface input/output devices 618 typically include a keyboard and may further include a pointing device and a scanner. The pointing device may be an indirect pointing device such as a mouse, trackball, touchpad, or graphics tablet, or a direct pointing device such as a touch screen incorporated into the display, or a three dimensional pointing device, such as the gyroscopic pointing device. Other types of user interface input devices, like voice recognition systems, can also be used. The output devices in the user interface input/output devices 618 typically include a printer and a display subsystem, the latter including a display controller and a display device coupled to the controller. The display device may be a cathode ray tube (CRT), a flat-panel device such as a liquid crystal display (LCD), or a projection device. The display subsystem may also provide non-visual display such as audio output.

The storage subsystem 606 maintains the basic required programming and data constructs. The program modules employed in the present invention are typically stored in the storage subsystem 606. The storage subsystem 606 typically comprises a memory subsystem 608 and file storage subsystem 614. The memory subsystem 608 typically includes a number of memories, including a main random access memory (RAM) 610 for storage of instructions and data during program execution, and a read only memory (ROM) 612, in which fixed instructions are stored. The file storage subsystem 614 provides persistent (non-volatile) storage for program and data files, and typically includes at least one hard disk drive and at least one floppy disk drive (with associated removable media). There may also be other devices such as a CD-ROM drive and optical drives (all with their associated removable media). Additionally, the system may include drives of the type with removable media cartridges. One or more of the drives may be located at a remote location, like in a server on a local area network or at a site on the Internet.

In the context of the present description, the term "bus subsystem" is used generically to include any mechanism for letting the various components and subsystems communicate with each other as intended. With the exception of the input devices and the display, the other components need not be at the same physical location. Thus, for example, portions of the file storage system could be connected via various local-area or wide-area network media, including telephone lines. Similarly, the input devices and display need not be at the same location as the processor, although it is anticipated that personal computers and workstations typically will be used. The bus subsystem 604 is shown schematically as a single bus, but a typical system has a number of buses, such as a local bus and one or more expansion buses (e.g., SCSI, ISA, EISA, MCA, or PCI), as well as serial and parallel ports. Network connections are usually established through a device such as the communications network interface 624 on one of these expansion buses or a modem on a serial port.

The communications network interface 624 receives scanned information from box labels and bag inscriptions via one or more optical scanners 620 (e.g., barcode scanners), as well as identification information read by an RFID receiver 621 from the RFID pucks 155, and communicates such information to a database in the memory 608 subsystem via the LAN. Clients of the communications network interface 624 include a plurality of PLCs 626. The PLCs 626 are used to control the functioning of the three conveyors 120, 122, 126 by means of conveyors 630, and the several functional stations or cells (described above with reference to FIG. 1) via packaging stations 632. Thus, the PLCs 626 control the electrical and pneumatic operations within each station or cell, and they store and retrieve multiple recipes to perform their respective tasks. The PLCs 626 communicate over the LAN to allow real time monitoring of the processing. The computer system 600, together with the PLCs 626, thus provides overall control and integration of the packaging system 100.

The one or more scanners 620 are employed for scanning identification media associated with a work part (such as barcodes printed on the box labels and on the bags), and they provide the scanned digital data set information to the computer or data processing system 600 for further processing. In a distributed environment, the scanner or scanners 620 may be located at appropriate packaging stations 632 (such as the bagging station 108 and the box filling station 11, as mentioned above), and they communicate scanned digital data set information to the computer or data processing system 600 via the communications network interface 624. The data may also be sent and printed, as desired, via printers 622. The packaging system 100 (FIG. 1) controls the packaging of the mass-customized items (e.g., dental aligners) by means of intermediate and final data set information received from the computer or data processing system 600. In a distributed environment, the packaging system 100 may be located at a remote location, and it receives data set information from the computer or data processing system 600 via the communications network interface 624, and specifically via the LAN included therein.

Additionally, the techniques described here may be implemented on hardware or software, or a combination of the two. The techniques may be implemented by computer programs executed on programmable computers, each including a processor, a storage medium, readable by the processor (including volatile and nonvolatile memory and/or storage elements), and suitable input and output devices. Program code is applied to data entered using an input device to perform the functions described and to generate output information. The output information is applied to one or more output devices.

Each program can be implemented in a high-level procedural or object-oriented programming language to operate in conjunction with a computer system. However, the programs can be implemented in assembly or machine language, if desired. In any case, the language may be a compiled or interpreted language. Each such computer program can be stored on a storage medium or device (e.g., CD ROM, hard disk, or magnetic diskette) that is readable by a general or special purpose programmable computer. Configuring and operating the computer is possible in a way that the storage medium or device is read by the computer, and performs the procedures described. The system also may be implemented as a computer-readable storage medium, configured with a computer program, where the storage medium so configured causes a computer to operate in a specific and predefined manner.

Figure 5:
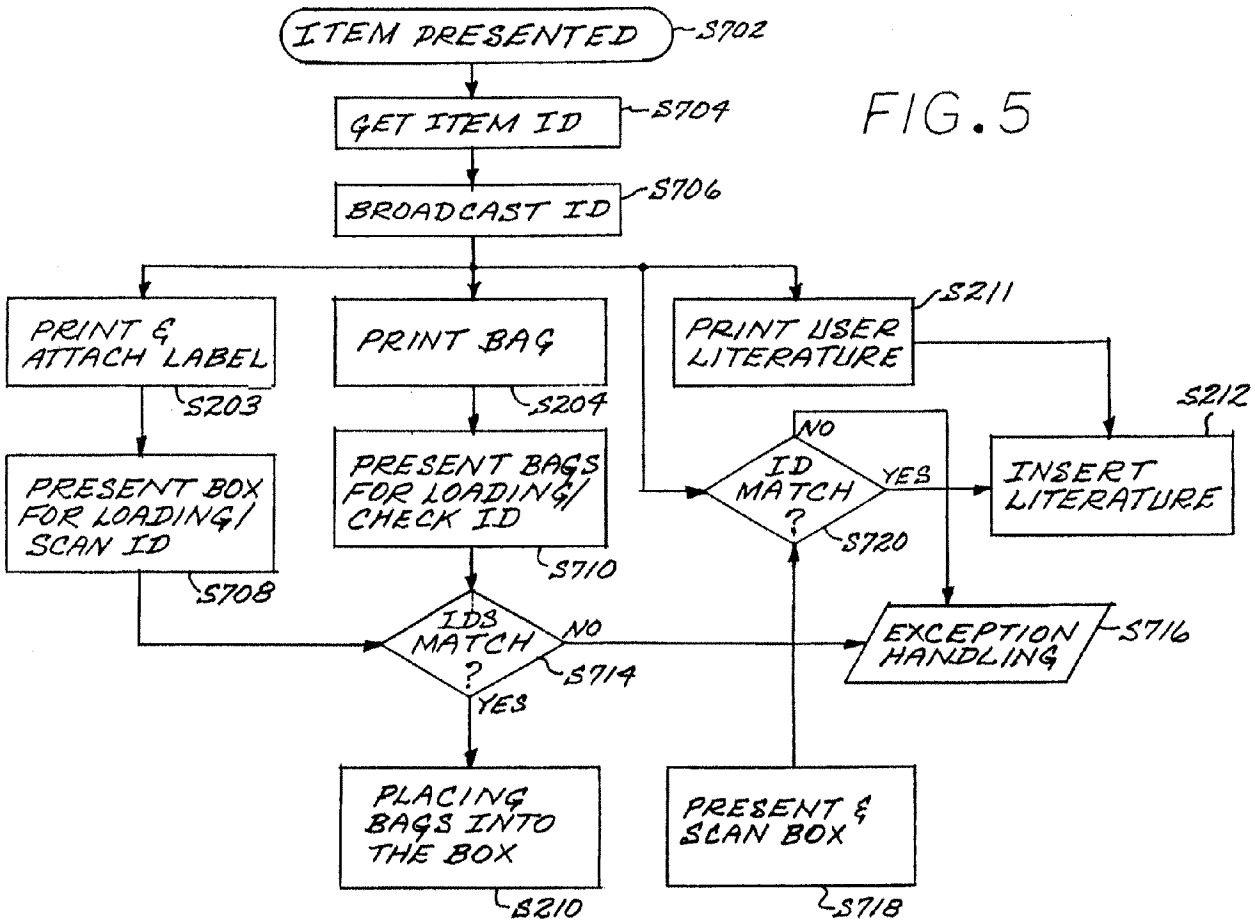
FIG. 5 is a flowchart showing the steps for packaging the items in the proper sequence and with the proper packaging identification, in accordance with an embodiment of the present invention.

FIG. 5 is a flowchart showing the steps incorporated into the process flow to assure packaging accuracy, in terms of packaging each item in its corresponding bag, packaging each strip of bags, in the proper sequence, in the appropriate box, and inserting the literature sheets in their appropriate boxes.

In step S702, the items to be packaged are presented to the pick and place apparatus 156 in the RFID pucks 155. In step S704, an RFID tag of each puck 155 is read to obtain identification (ID) information. In step S706, the ID information is sent via the LAN to the box label applicator 106, the bag printer 130, and the literature printers 216.

In steps S203, S204 and S211, as discussed above with reference to FIG. 2, the required user information is retrieved, via the LAN, from the database in the memory subsystem 608 and printed on the box labels, the bag inscriptions, and the literature, respectively. The printed information may advantageously include barcodes that are used in subsequent ID scanning operations. Each bag is filled with one or more items with matching identification information, and then sealed (Steps S205-S208 in FIG. 2), and the bag strings are cut in accordance with the predetermined groups (S209), as discussed above. In steps S708 and S710, the identification information on each box and on each bag is read, and in step S714 it is determined if the bag ID information matches the ID information of the presented box. If the box and bag ID information matches, the bags (having been cut into properly sequenced strips by group as discussed above) are manually loaded into the appropriate box in step S210, as discussed above, wherein an operator manually fan folds the bag strips 900 while placing them into the appropriate box in the predetermined sequence. If the box ID information and the bag ID information do not match, the system identifies the relevant box and bag for special handling (step S716).

In step S718, the box label is scanned again, and in step S720, it is determined if the box ID information matches the ID information of the available user literature. If there is a match, the literature is inserted into the box (step S212). If there is no match, the special handling step (S716) is implemented.

Figure 33:
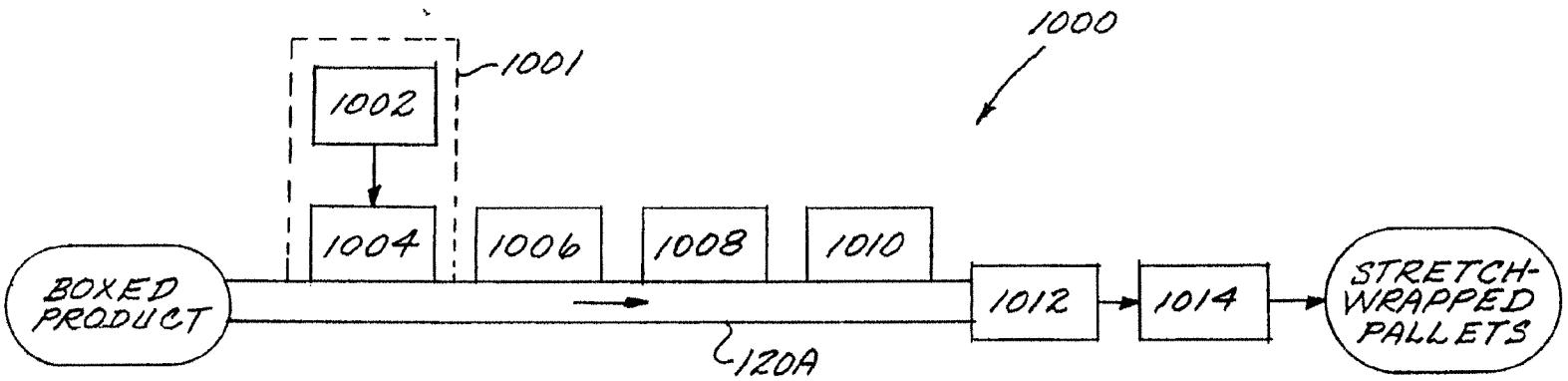
FIG. 33 is a block diagram of a system for loading the boxes into shipping cartons and for palletizing the shipping cartons.

FIG. 33 is a block diagram or flow chart of a system 1000 for loading the boxes 300 into shipping cartons, and then palletizing the filled shipping cartons. The system receives the labeled and sealed boxes 300 from the packaging system 100 (FIG. 1) on a shipping carton line 120A. The first station on the shipping carton line 120A is shipping carton forming and loading machine 1001 that includes a carton forming apparatus 1002 and a box-loading apparatus 1004 that loads the requisite number of boxes 300 into each shipping carton (not shown) formed by the carton forming apparatus 1002. Suitable shipping carton forming and loading machines are commercially available, one such machine being the "E-System 2000" automatic cartoner, available from Econocorp, Inc., of Randolph, Mass. The system 1000 may employ more than one carton forming and loading machine 1001 to form and load cardboard shipping cartons of different sizes. Alternatively, the shipping cartons may be created by a separate box-forming machine, such as the Doboy, Inc. "Cobra," mentioned above, with the cartons then being loaded with the boxes 300 by a separate (commercially available) carton loading machine.

The filled cartons then move to a literature insertion station 1006, which advantageously includes the literature insertion apparatus 220 described above in connection with FIGS. 28-32. The literature may also be printed at the literature insertion station 1006, in which case the station would include computer-controlled printers (not shown), of the type, advantageously, described above. After the literature is inserted, the cartons are manually sealed at a sealing station 1008.

The sealed shipping cartons are then moved to a labeling station 1010, which prints and applies a shipping label to each carton, based on information received from the computer system via the LAN. The labeling 1010 station includes one or more box label applicators, which may advantageously be of the type described above for applying labels to the individual boxes 300. Thus, for example, the label applicator or applicators may be the above-mentioned Model 2000e label applicator, from Panther Industries, Inc.

The sealed and labeled cartons are then removed from the line 120A, and they are manually loaded onto pallets (not shown) at a palletizing station 1012. The pallets are then loaded onto a commercially available pallet wrapping machine 1014, such as, for example, the Lantech.com Model Q-300 semi-automatic stretch wrapping system, available from Lantech.com, of Louisville, Ky., where they are wrapped in conventional plastic stretch-wrap. The wrapped pallets are now ready for shipping.

While the present invention is described above with respect to what is currently considered as preferred embodiments, it is to be understood that the invention is not limited to the above-described exemplary embodiments. A number of modifications and variations, of both the method and apparatus of the invention, will suggest themselves to those skilled in the pertinent arts, and the scope of the invention is intended to encompass such modifications, variations, and equivalent arrangements, as defined and encompassed by the appended claims.

What is claimed is:

1. A method of packaging mass-customized items sorted by group in a predetermined sequence, each item being associated with predefined item information, the method comprising:

creating a computer database containing item information including (a) item identification information unique to each mass-customized item, (b) item grouping information identifying a predefined group of items to which each item belongs, and (c) item sequencing information defining a predetermined sequence for the items in each group;

providing a series of outer containers;

associating item information received from the database with each outer container;

providing a series of inner packs;

associating item information received from the database with each inner pack;

filling each inner pack with at least one item matched to that inner pack by information received from the database, whereby each item is associated with its unique item identification information and is inserted into an inner pack associated with matching item identification information, and wherein the inner packs are filled in a sequence determined by the item sequencing information; and filling each outer container with the inner packs matched to that outer container by information received from the database, whereby each outer container is associated the item grouping information for a specific group of items, and the inner packs are inserted into an outer container with matching item grouping information in the sequence determined by the item sequencing information.

2. The method of claim 1, wherein the item information is received from the database via a local area network (LAN).

3. The method of claim 1, wherein the item information is applied to the outer containers and the inner packs so as to be readable by an optical scanner.

4. The method of claim 1, wherein the filling step includes (a) delivering each of the items with encoded item information; and (b) reading the encoded item information delivered with the items and transmitting the item information to a computer system employing the database for matching against the item information with which each of the inner packs is associated.

5. The method of claim 4, wherein the items are delivered in item carriers provided with an RFID chip encoded with the item information, and wherein the step of reading the encoded item information includes reading the RFID-encoded information.

6. The method of claim 4, wherein the items include the item information in optically scannable code, and wherein the step of reading the encoded item information includes optically scanning the code.

7. The method of claim 1, wherein the inner packs are plastic bags, and wherein the step of providing the inner packs comprises:

providing the bags in a continuous interconnected bag string; and applying the item identification information to each bag in the bag string.

8. The method of claim 7, wherein the step of filling the inner packs comprises:

filling each bag in the string with at least one specific item matched to that bag by the item information received from the database, whereby each item is associated with its unique item information and is inserted into a bag with matching item information;

sealing the bags in the bag string; and cutting the bag strings into strips, wherein each bag in a strip belongs to a single group determined by the item grouping information received from the database.

9. The method of claim 1, wherein the outer containers are boxes, and wherein the step of providing a plurality of outer containers comprises:

forming a plurality of boxes out of cardboard sheets; and applying a label to each box that is imprinted with the item identification information;

10. The method of claim 9, wherein the step of manufacturing the boxes includes the step of installing a divider in each box so as to divide the interior of each box into at least two compartments.

11. A method of packaging mass-customized items, comprising:

(a) creating a database in which each item in a plurality of mass-customized items is associated with predefined item identification information unique to that item;

(b) providing a plurality of outer containers, each of which is associated with item identification information received from the database for at least one of the plurality of mass-customized items;

(c) providing a plurality of inner packs, each of which is associated with item identification information received from the database for at least one item;

(d) filling each inner pack with at least one specific item of the plurality of mass-customized items matched to that inner pack by the item identification information received from the database, wherein each item of the plurality of mass-customized items is associated with its unique item identification information and is inserted into an inner pack with matching item identification information; and (e) loading each outer container with at least one inner pack matched to that outer container by the item identification information unique to each specific item in the at least one inner pack.

12. The method of claim 11, wherein the item identification information is received from the database via a local area network (LAN).

13. The method of claim 11,wherein the item identification information is applied to the outer containers and the inner packs so as to be readable by an optical scanner.

14. The method of claim 11, wherein the filling step includes (a) delivering each of the items with its unique item identification information in encoded form; and (b) reading the encoded item identification information delivered with the items and transmitting the item identification information to a computer system employing the database for matching against the item identification information with which each of the inner packs is associated.

15. The method of claim 14, wherein the items are delivered in item carriers provided with an RFID chip encoded with the item identification information, and wherein the step of reading the encoded item identification information includes reading the RFID-encoded information.

16. The method of claim 14, wherein the items include the item identification information in optically scannable code, and wherein the step of reading the encoded item identification information includes optically scanning the code.

17. The method of claim 11 wherein the inner packs are plastic bags, and wherein the step of providing the inner packs comprises:

providing the bags in a continuous interconnected bag string; and applying the item identification information to each bag in the bag string.

18. The method of claim 17, wherein the step of filling the inner packs comprises:

filling each bag in the string with at least one specific item matched to that bag by the item identification information received from the database, whereby each item is associated with its unique item identification information and is inserted into a bag with matching item identification information;

sealing the bags in the bag string; and cutting the bag strings into strips, wherein each bag in a strip belongs to a single group determined by item grouping information received from the database.

19. The method of claim 11, wherein the outer containers are boxes, and wherein the step of providing a plurality of outer containers comprises:

forming a plurality of boxes out of cardboard sheets; and applying a label to each box that is imprinted with the item identification information;

20. The method of claim 19, further comprising installing a divider in each box so as to divide the interior of each box into at least two compartments.

* * * * *